US007862142B2

(12) United States Patent
Taira

(10) Patent No.: US 7,862,142 B2
(45) Date of Patent: Jan. 4, 2011

(54) INK JET HEAD

(75) Inventor: Hiroshi Taira, Ichinomiya (JP)

(73) Assignee: Brother Kogyo Kabushiki Kaisha, Nogoya-shi, Aichi-ken (JP)

( * ) Notice: Subject to any disclaimer, the term of this patent is extended or adjusted under 35 U.S.C. 154(b) by 829 days.

(21) Appl. No.: 11/272,769

(22) Filed: Nov. 15, 2005

(65) Prior Publication Data

US 2006/0103700 A1 May 18, 2006

(30) Foreign Application Priority Data

Nov. 17, 2004 (JP) ..... 2004-332665
Feb. 15, 2005 (JP) ..... 2005-037351

(51) Int. Cl.
*B41J 2/015* (2006.01)
*B41J 2/175* (2006.01)

(52) U.S. Cl. ..... 347/20; 347/85

(58) Field of Classification Search ..... 347/70–72, 347/93, 85, 20
See application file for complete search history.

(56) References Cited

U.S. PATENT DOCUMENTS

| | | | | |
|---|---|---|---|---|
| 4,604,633 | A * | 8/1986 | Kimura et al. | 347/7 |
| 5,489,930 | A * | 2/1996 | Anderson | 347/71 |
| 6,152,557 | A | 11/2000 | Hagiwara et al. | |
| 6,244,698 | B1 * | 6/2001 | Chino et al. | 347/94 |
| 6,312,094 | B1 * | 11/2001 | Ito et al. | 347/36 |
| 7,021,751 | B2 * | 4/2006 | Merz et al. | 347/86 |
| 7,044,591 | B2 | 5/2006 | Taira | |
| 7,427,127 | B2 * | 9/2008 | Ando et al. | 347/85 |
| 2003/0011662 | A1 * | 1/2003 | Tobita et al. | 347/70 |
| 2003/0025766 | A1 * | 2/2003 | Tanaka et al. | 347/65 |
| 2005/0073562 | A1 | 4/2005 | Taira | |
| 2006/0092247 | A1 | 5/2006 | Taira | |

FOREIGN PATENT DOCUMENTS

| | | |
|---|---|---|
| EP | 0 774 356 | 5/1997 |
| EP | 0 855 274 | 7/1998 |
| EP | 1 078 760 | 2/2001 |
| EP | 1 285 761 | 2/2003 |
| EP | 1 375 148 | 1/2004 |
| EP | 1 547 775 | 6/2005 |
| JP | 01 257058 | 10/1989 |
| WO | WO99/21721 | 5/1999 |

OTHER PUBLICATIONS

European Patent Office Search Report based on European Patent Application 05024845.9.

* cited by examiner

*Primary Examiner*—Julian D Huffman
*Assistant Examiner*—Jason S Uhlenhake
(74) *Attorney, Agent, or Firm*—Banner & Witcoff, Ltd

(57) ABSTRACT

Pressure fluctuations that occur inside an ink jet head will be controlled. The ink jet head has a body. A common ink storage chamber is formed inside the body. A plurality of nozzles and a plurality of pressure chambers are formed in the surface of the body. One nozzle corresponds to one pressure chamber, and one pressure chamber corresponds to one nozzle. A plurality of individual ink storage chambers are formed inside the body. Each individual ink path extends from the common ink storage chamber, through one corresponding pressure chamber, and to one corresponding nozzle. The ink jet head is provided with an adjustor that allows the volume of the common ink storage space to increase or decrease. When the pressure of the ink that is stored in the ink jet head fluctuates, the volume of the common ink storage space will increase or decrease, and the pressure fluctuations will be smoothed.

11 Claims, 16 Drawing Sheets

( a )

( b )

(a)

(b)

(a)

(b)

INK JET HEAD

CROSS-REFERENCE TO RELATED APPLICATIONS

This application claims priority to Japanese Patent Applications No. 2004-332665 filed on Nov. 17, 2004 and No. 2005-037351 filed on Feb. 15, 2005, the contents of which are hereby incorporated by reference into the present application.

BACKGROUND OF THE INVENTION

1. Field of the Invention

The present invention relates to an ink jet head.

2. Description of the Related Art

An ink jet head is equipped with an ink introduction port that accepts ink supplied from an ink tank arranged on an exterior of the inkjet head, nozzles that jet ink to the exterior of the ink jet head, and ink passages that connect the ink introduction port with the nozzles.

A standard inkjet head is provided with a large number of nozzles. When the resistances of the ink passages to the nozzles differ for each nozzle when ink flows therein, printing quality will decline. Accordingly, the technology disclosed in Japanese Laid-Open Patent Application Publication 2004-114423 has been developed. This ink jet heat is provided with one ink storage chamber that is formed-within the ink jet head, and a plurality of individual ink passages that are formed within the ink jet head. Each individual ink passage is connected to one nozzle. Each individual ink passage is connected to a common ink storage chamber. The ink introduced from the ink introduction port is guided to the ink storage chamber. The ink introduced to the ink storage chamber is distributed to the plurality of individual ink passages. When a common ink storage chamber is provided within the ink jet head, the problem of the resistances of the ink passages to the nozzles differing for each nozzle when ink flows therein will be solved.

BRIEF SUMMARY OF THE INVENTION

The ink passages that connect the ink introduction port with the nozzles are formed within the inkjet head. The ink jet head that forms the ink passages is formed with a highly rigid material, and the volume of the ink passages is fixed. When the common ink storage chamber is formed along the ink passages, the common ink storage chamber can become a part of the ink passages. Even if the common ink storage chamber is formed along the ink passages, the volume of the ink passages that include the common ink storage chamber will be fixed.

The following problems frequently occur when the ink is supplied to the ink passages and/or the ink is discharged from the ink passages, because the volume of the ink passages is fixed and the ink is not compressible.

It will be difficult to make the quantity of ink that is supplied to the ink jet head equal to the quantity of ink that is jetted from the ink jet head. When observed in short time intervals, if there are periods of time in which the supply quantity is greater than the jetted quantity, then there will also be periods of time in which the supply quantity is less than the jetted quantity. If the supply quantity is greater than the jetted quantity, the non-compressible ink cannot be captured in the fixed volume ink passages. If the supply quantity is less than the jetted quantity, there will be a shortage of ink within the ink jet head.

Immediately after starting a printing operation by the ink jet head, the supply quantity tends to be less than the jetted quantity, and negative pressure tends to be developed within the ink jet head. If the supply quantity is less than the jetted quantity and negative pressure is developed within the ink jet head, ink cannot be brought up to the nozzles. When the ink is not being jetted from the nozzle, it is preferable that a surface of the ink exposed to the atmosphere at the nozzle extends from a ring like boundary circling the nozzle at a tip face of the ink jet head due to surface tension of the ink. This state is termed that the ink is brought up to the nozzle. If the supply quantity is less than the jetted quantity and negative pressure is developed within the ink jet head, ink cannot be brought up to the nozzles and the ink is drawn into the nozzles.

Immediately after stopping the printing operation by the ink jet head, the ink tends to flow into the ink jet head due to inertia force of the flowing ink. The supply quantity tends to be greater than the jetted quantity, and positive pressure tends to be developed within the ink jet head. If the supply quantity is greater than the jetted quantity and positive pressure is developed within the ink jet head, the ink will ooze out from the nozzles.

A situation in which the ink oozes from the nozzles due to the supply quantity of the ink being greater than the jetted quantity thereof is undesirable. A situation in which the ink is drawn into the nozzles due to the supply quantity of the ink being less than the jetted quantity thereof is also undesirable. When the ink is drawn into the nozzles, the ink may not be jetted from the nozzles, even if pressure is applied to the ink within the ink passages that are connected to the nozzles. In the alternative, the quantity of ink that is jetted from the nozzles will be insufficient.

When there are large fluctuations in the pressure applied to the ink stored within the ink jet head, the quantity of ink jetted from the nozzles will be unstable, and printing quality will decline. The present inventor found that it is very important to suppress the pressure fluctuations within the ink jet head under the printing operation in order to maintain high quality printing.

An object of the present invention is to provide an ink jet head in which problems will not occur, even in the event that the quantity of ink supplied to the ink jet head is not equal to the quantity of ink that is jetted from the ink jet head.

Another object of the present invention is to provide an inkjet head that will prevent ink from oozing from the nozzles, even in the event that the supply quantity of ink is greater than the jetted quantity.

Yet another object of the present invention is to provide an ink jet head in which the quantity of ink jetted from the nozzles is not insufficient, even in the event that the supply quantity of ink is less than the jetted quantity.

Yet another object of the present invention is to provide an ink jet head that suppresses the range of fluctuation in the pressure applied to the ink that is stored within the ink jet head.

Yet another object of the present invention is to provide an ink jet head that suppresses large pressure fluctuation that tends to be generated immediately after starting the printing operation or stopping the printing operation, and the quantity of ink that is jetted from the nozzles will be stable in those timings.

The ink jet head of the present invention has a body. A common ink storage chamber, along with a common ink passage for introducing ink supplied from an exterior of the body to the common ink storage chamber, are formed within the body. A plurality of nozzles is distributed on a first face of the body. A plurality of pressure chambers is distributed within the body. The number of pressure chambers is equal to the number of nozzles. One nozzle corresponds to one pressure chamber, and one pressure chamber corresponds to one nozzle. A plurality of individual ink passages are formed within the body. The number of individual ink passages is equal to the number of nozzles. One nozzle corresponds to one individual ink passage, and one individual ink passage corresponds to one nozzle. One individual ink passage extends from the common ink storage chamber to one corresponding nozzle through one corresponding pressure chamber. The ink jet head of the present invention is equipped with an adjustor for allowing the volume of a common ink storage space to change.

The common ink storage space referred to here is a space between the ink introduction port that accepts ink supplied from the exterior of the ink jet head, and a branching point to the plurality of individual ink passages, and is filled with ink. The common ink passage is a portion of the common ink storage space. The common ink storage chamber is also a portion of the common ink storage space. Some of the ink jet heads have an ink discharge passage for discharging the ink stored in the common ink storage chamber to the exterior of the body. The ink discharge passage may be filled with ink during usage of the ink jet head. In this situation, the ink discharge passage is also a portion of the common ink storage space.

The adjustor may allow the volume of the common ink passage to change, may allow the volume of the common ink storage chamber to change, or may allow the volume of the ink discharge passage to change.

The adjustor may be formed by a space for capturing air directly contacting with ink within the common ink storage space. The air capturing space may be connected to the common ink passage to allow the volume change thereof, may be connected to the common ink storage chamber to allow the volume change thereof, or may be connected the ink discharge passage to allow the volume change thereof. For instance, when the air capturing space is connected to the common ink storage chamber, the air capturing space may be a part of the common ink storage chamber. The ink fills the common ink storage chamber except the air capturing space. The space filled with the ink within the common ink storage space is allowed to change due to the captured air. The space filled with the ink within the common ink storage chamber except the air capturing space is expanded when the air is compressed. The ink storing space is reduced when the air is expanded.

When the adjustor is formed by the space for capturing air, a flexible film for separating the air and the ink is not required. The air and the ink directly contact. Even if there is no separating film between the air and the ink, the ink does not penetrate into the air capturing space. The volume of the common ink storage space that is filled with the ink may be adjusted by the volume change of the captured air.

When the air and the ink directly contact, and there is no film between the air and the ink, the boundary between the air and the ink freely shifts in accordance with the pressure difference between the air and the ink. A phenomenon does not occur that the separating film adds resistance against the free shift of the boundary. When the air and the ink directly contact, large pressure fluctuation that tends to be generated within the ink immediately after starting the printing operation or stopping the printing operation is effectively suppressed due to free shift of the boundary. When the adjustor is formed by the space for capturing the air directly contacting with the ink, the quantity of the ink that is jetted from the nozzles will be stable in every timings including immediately after starting the printing operation or stopping the printing operation.

When the air is captured within the common ink storage space, problems will not occur even in the event that the quantity of ink supplied to the ink jet head is not equal to the quantity of ink that is jetted from the ink jet head. When the supply quantity is greater than the jetted quantity, the captured air is compressed, the actual ink volume within the common ink storage space (the volume in which the volume of the captured air is reduced from the volume of the common ink storage space) is increased, and excess pressure increase of the ink is suppressed. When the supply quantity is less than the jetted quantity, the captured air is expanded, the actual ink volume within the common ink storage space is decreased, and excess pressure drop of the ink is suppressed.

The adjuster may be formed by a flexible sheet separating the ink within the common ink storage space from the atmosphere. For instance, a part of wall defining the common ink storage chamber may be flexible. Alternatively, a part of wall or entire wall defining the ink discharge passage may be flexible.

The pressure of the atmosphere is maintained constant regardless of the pressure fluctuation of the ink within the common ink storage space. When the adjuster is formed by the flexible sheet separating the ink from the atmosphere, large pressure fluctuation that tends to be generated within the ink immediately after starting the printing operation or stopping the printing operation is effectively suppressed due to stable pressure of the atmosphere. When the adjuster is formed by the flexible sheet separating the ink from the atmosphere, the quantity of ink that is jetted from the nozzles will be stable in every timings including immediately after starting the printing operation or stopping the printing operation.

When the adjuster is formed by the flexible sheet separating the ink from the atmosphere, problems will not occur even in the event that the quantity of ink supplied to the ink jet head is not equal to the quantity of ink that is jetted from the ink jet head. When the supply quantity is greater than the jetted quantity, the volume of the common ink storage space is increased, and excess pressure increase of the ink is suppressed. When the supply quantity is less than the jetted quantity, the volume of the common ink storage space is decreased, and excess pressure drop of the ink is suppressed.

BRIEF DESCRIPTION OF THE DRAWINGS

FIG. 4(*a*) shows a plan view of plate 71, FIG. 4(*b*) shows a plan view of plate 72, FIG. 4(*c*) shows a plan view of plate 73, FIG. 4(*d*) shows a plan view of plate 74, FIG. 4(*e*) shows a plan view of plate 75, and FIG. 4(*f*) shows a plan view of plate 76.

FIG. 16(*a*) shows a plan view of plate 171, FIG. 16(*b*) shows a plan view of plate 172, FIG. 16(*c*) shows a plan view of plate 173, FIG. 16(*d*) shows a plan view of plate 174, FIG. 16(*e*) shows a plan view of plate 175, FIG. 16(*f*) shows a plan view of plate 176, FIG. 16(*g*) shows a plan view of plate 177, and FIG. 16(*h*) shows a plan view of plate 178.

DETAILED DESCRIPTION OF THE INVENTION

Figure 1:
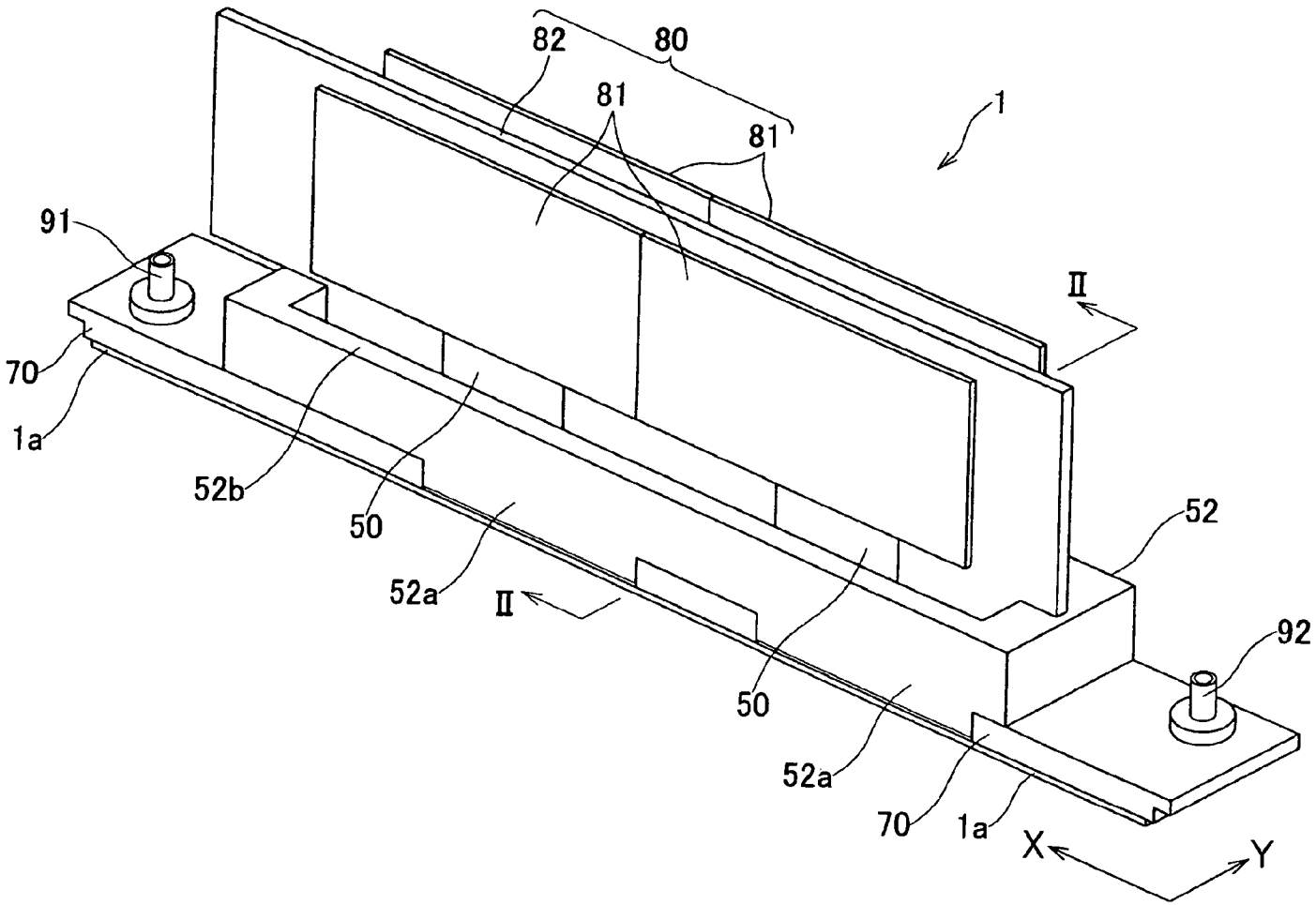
FIG. 1 is an oblique view of an ink jet head of a first embodiment.

Preferred embodiments of the present invention will be described below with reference to the drawings. As shown in FIG. 1, an ink jet head 1 of a first embodiment has a long shape in an X direction. The ink jet head 1 has, in sequence from below, a head body 1*a*, a reservoir unit 70, and a control unit 80. The constituent elements of the ink jet head 1 will be described in sequence from above. Note that reference numeral 52 represents a lower cover. A sheet that is to be printed by the ink jet head 1 will pass below the ink jet head 1 in the Y direction. The width of the sheet in the X direction is shorter than the length of the ink jet head 1 in the X direction. The ink jet head 1 can simultaneously print across the entire width of the sheet in the X direction. Because the sheet passes below the ink jet head 1 in the Y direction, the ink jet head 1 can print on the entire area of the sheet.

The control unit 80 will be described with reference to FIG. 1 and FIG. 2. The control unit 80 comprises one main board 82, a total of four sub-boards 81, a total of 4 driver ICs 84, and a total of 4 FPCs (Flexible Printed Circuits) 50.

As shown in FIG. 1, the main board 82 and the sub-boards 81 have rectangular planar surfaces extending in the X direction, and are erected in parallel with each other. As shown in FIG. 2, the main board 82 is fixed to the upper surface of the reservoir unit 70. The sub-boards 81 are spaced apart from both sides of the main board 82. Two of the sub-boards 81 are provided on one side of the main board 82. The main substrate 82 and each sub-board 81 are electrically connected to each other by means of connectors.

The FPCs (Flexible Printed Circuits) 50 are members in which a wiring pattern is formed on a flexible insulation film, and the upper end of each FPC 50 is connected to the corresponding sub-board 81. One driver IC 84 is fixed to the central portion of each FPC 50. The lower end of each FPC 50 is connected to each actuator unit 21 described below. Each driver IC 84 is thermally bonded to the sub-board 81 via a heat sink 83.

A master control board is provided in an ink jet printer not shown in the drawings. That master control board and the main control board 82 are connected by an FPC that is not shown in the drawings. Signals that are transmitted by the master control board installed in the ink jet printer are transmitted to the four driver ICs 84 via the main board 82, the four sub-boards 81, and the four FPCs 50. Each driver IC 84 produces drive signals for the corresponding actuator unit 21, and outputs them to the corresponding actuator unit 21 via the FPCs 50. The four actuator units 21 operate in accordance with the control signals of the master control board installed in the ink jet printer. The driver ICs 84 generate heat, when they operate. The heat generated by the driver ICs 84 is transmitted to the sub-boards 81 via the heat sinks 83, and is dissipated from the sub-board 81.

The lower cover 52 is arranged on the ink jet head 1. An upper cover 51 is fitted on the upper portion of the lower cover 52. The control unit 80 is capped by the lower cover 52 and the upper cover 51. Ink that has become airborne during printing will be prevented from adhering to the control unit 80 etc. by means of the covers 51, 52. Note that in FIG. 1, the upper cover 51 is omitted so that the control unit 80 is visible.

Figure 2:
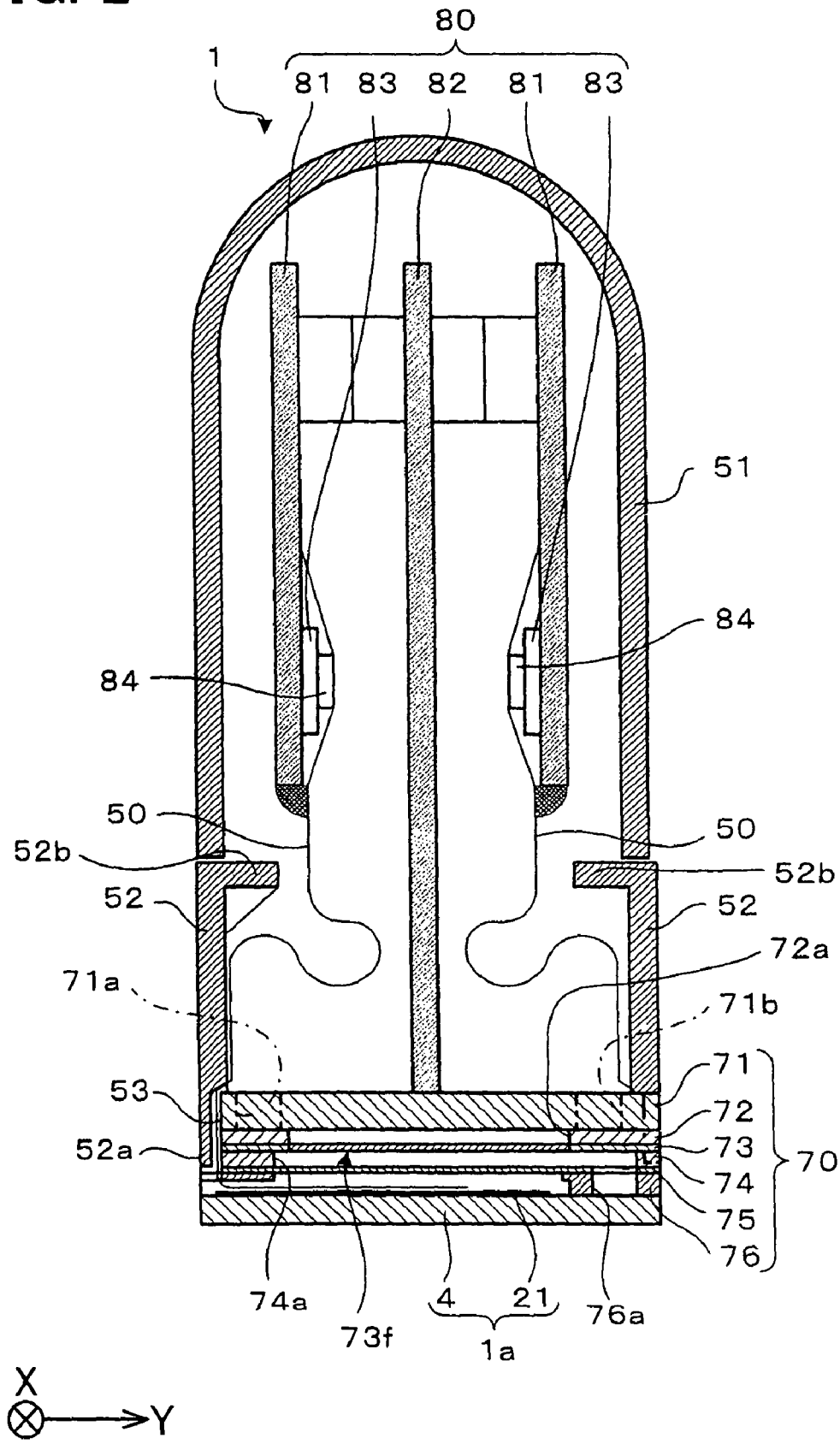
FIG. 2 is a cross-sectional view of the ink jet head taken along line 11-11 of FIG. 1.

As shown in FIG. 2, the upper cover 51 has an arch-shaped ceiling, and caps the control unit 80. The lower cover 52 is a substantially square tubular shape that is open vertically, and caps the lower portion of the main substrate 82. The FPCs 50 are in a relaxed state within the space that is capped by the lower cover 52. Because the FPCs 50 are in a relaxed state, there is no stress applied to the FPCs 50. Upper walls 52*b* that project inward from the upper ends of the lateral walls are formed on the upper portions of the lower cover 52. The lower ends of the upper cover 51 are provided on the upper surface of the upper walls 52*b*. The lower cover 52 and the upper cover 51 have substantially the same width along Y direction in FIG. 1 as the head body 1*a*.

Two projections 52*a* that project downward are formed on each of the lower ends of both lateral walls of the lower cover 52 along the length thereof (only one lateral wall is shown in FIG. 1). As will be described below with reference to FIG. 4, two recesses 53 are formed on each side of the reservoir unit 70 along the length thereof. As shown in FIG. 2, each projection 52*a* is accommodated within the corresponding recesses 53 of the reservoir unit 70. The FPCs 50 pass through the gaps between the projections 52*a* and the recesses 53. The tips of the projections 52*a* face a passage unit 4 described below. There is a relationship that gaps are formed between the tips of the projections 52*a* and the passage unit 4. Even if manufacturing errors occur in some components, the impact of the manufacturing errors can be absorbed due to the presence of the gaps. These gaps are closed by filling them with a silicone resin or the like. The lower edges of the lateral walls of the lower cover 52, except for the projections 52*a*, are provided on the upper surface of the reservoir unit 70.

Figure 5:
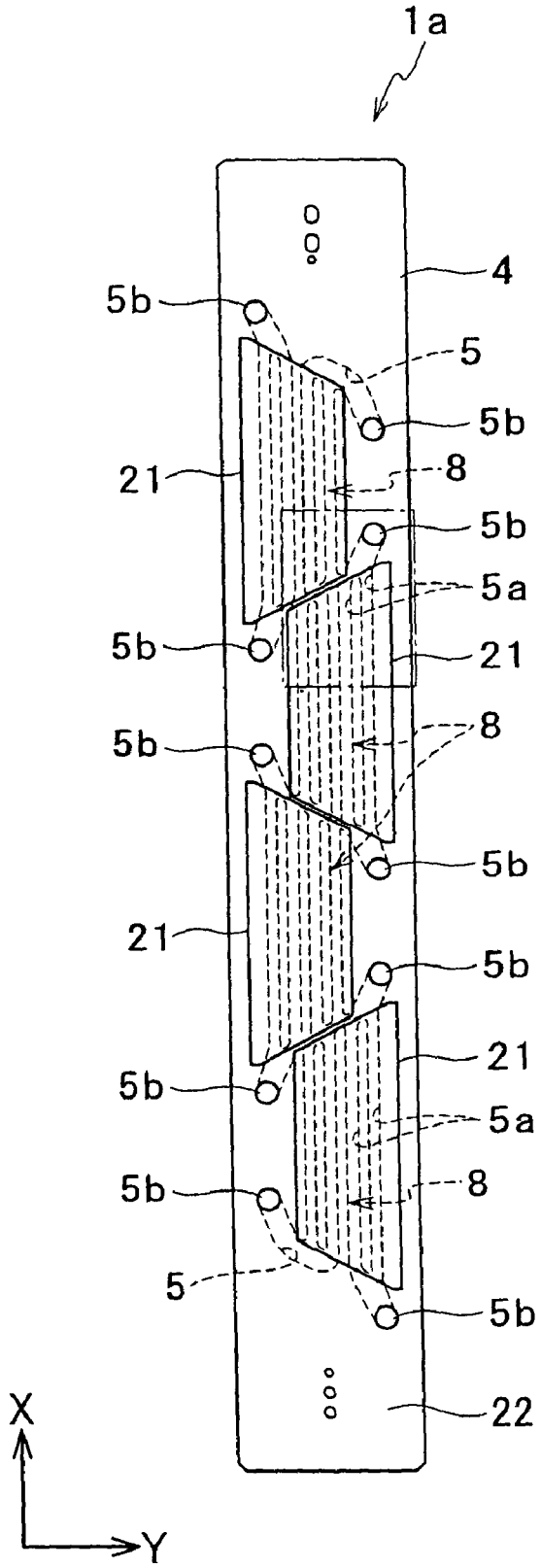
FIG. 5 is a plan view of the head body shown in FIG. 1.

As shown in FIG. 2, the lower end portions of the FPCs 50 that are pulled through the gaps between the projections 52*a* and the recesses 53 extend horizontally along the upper surfaces of the actuator units 21. The lower end portions of the FPCs 50 are connected to the upper surfaces of the actuator units 21. As shown in FIG. 5, a total of four actuator units 21 are fixed to the upper surface of one passage unit 4. One FPC 50 is connected to one actuator unit 21. One driver IC 84 and one sub-board 81 are connected to one actuator unit 21 through one FPC 50.

Figure 3:
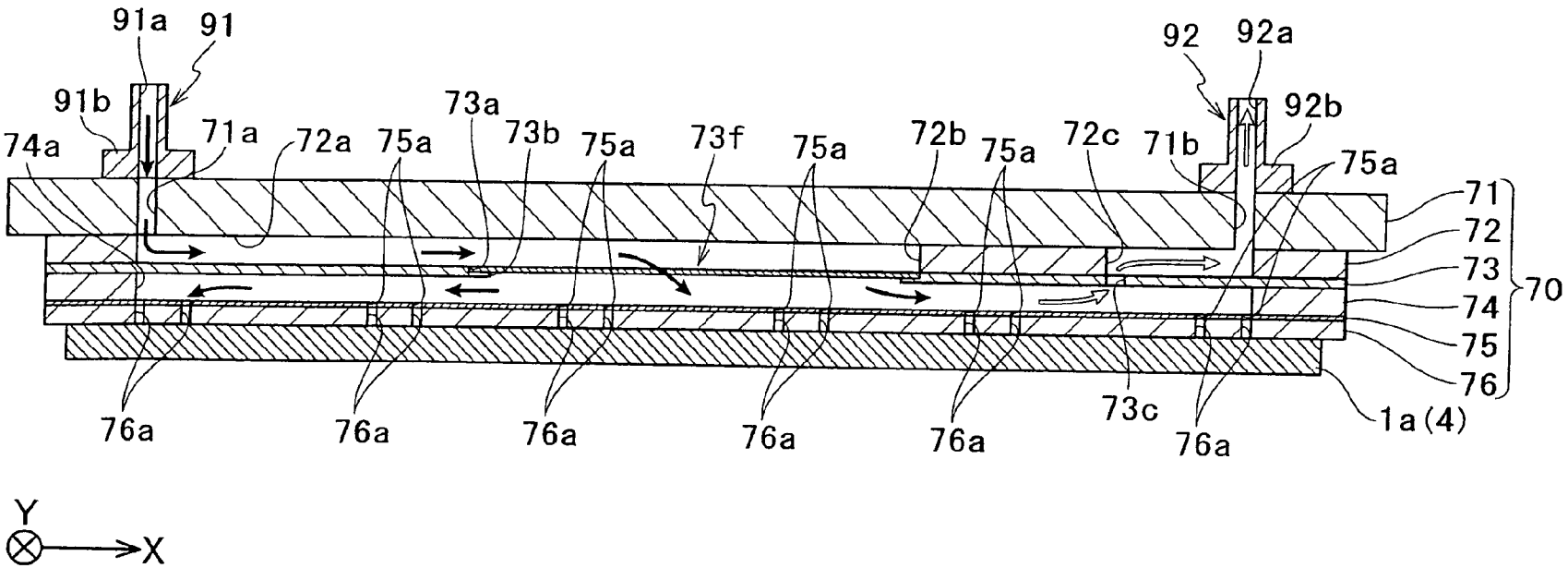
FIG. 3 is a cross-sectional view of a reservoir unit and a head body that forms a part of the ink jet head when viewed in the direction of the arrow Y of FIG. 1.

Next, the reservoir unit 70 will be described with reference to FIGS. 2 to 4. Note that in FIG. 2 and FIG. 3, a cross-sectional display of the below-described passage unit 4 is omitted. In FIG. 3, the scale in the vertical direction is increased for ease of explanation. In addition, in FIG. 3, structures that do not originally appear in the same cross-section are also shown as needed for ease of explanation.

Figure 4:
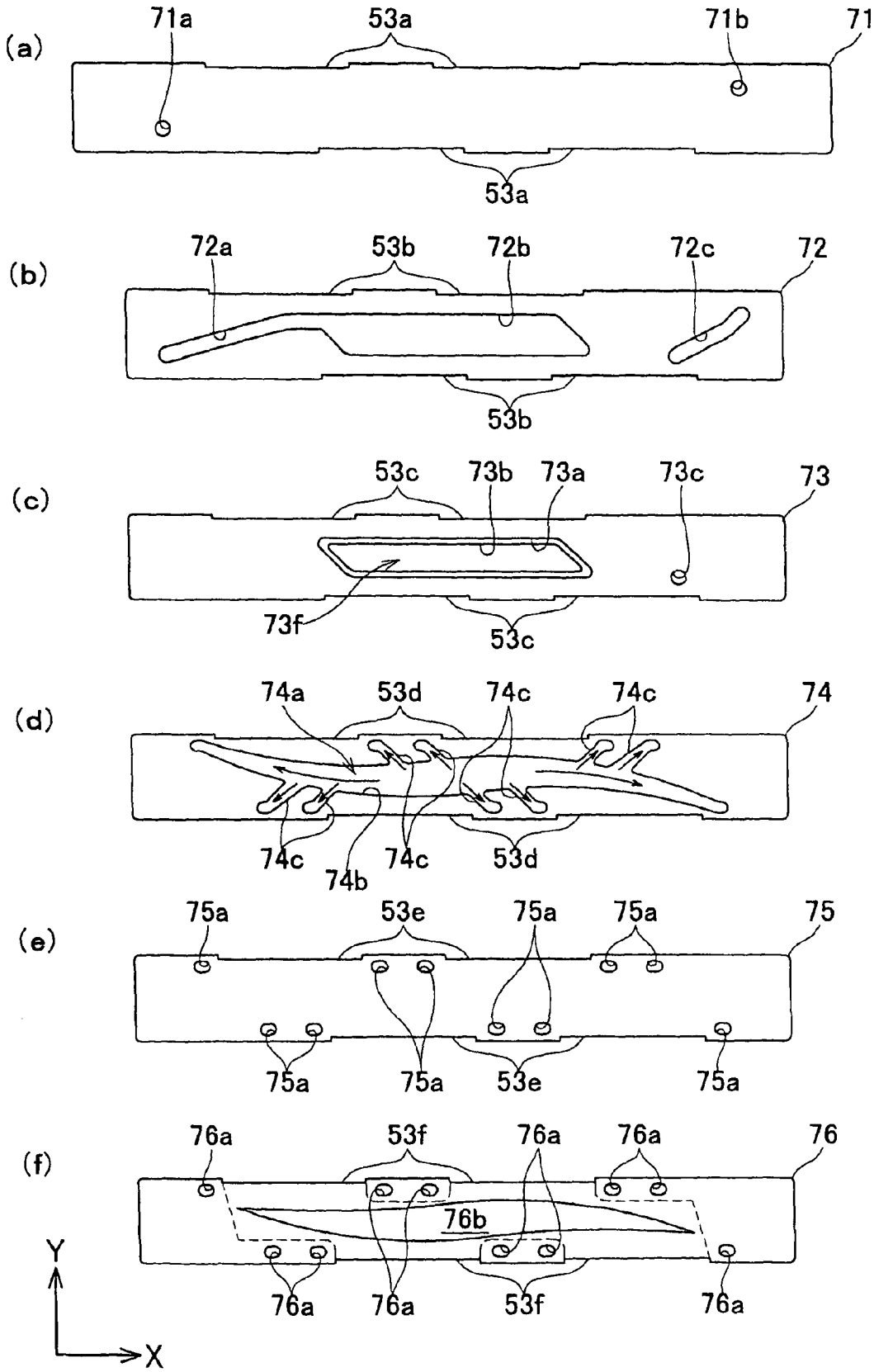
FIG. 4(*a*) to FIG. 4(*f*) show plan views of plates constructing the reservoir unit shown in FIG. 3.

The reservoir unit 70 is constructed of a total of 6 plates 71, 72, 73, 74, 75, 76 shown in FIG. 4(*a*), (*b*), (*c*), (*d*), (*e*), (*f*) by stacking them as shown in FIG. 3.

As shown in FIG. 3, the uppermost first plate 71 has a thickness that is larger than the other plates, is slightly longer than the other plates, and both ends thereof in the lengthwise direction project outward. As shown in FIG. 4(*a*), round holes 71*a*, 71*b* are respectively formed by etching or the like in the vicinity of both ends in the lengthwise direction of the first plate 71. The round hole 71*a* is an ink introduction port for introducing ink to the ink jet head 1, and as shown in FIG. 1, will be fixed later to an ink supply joint 91. The round hole 71*b* is an ink discharge port for discharging ink from the ink jet head 1, and as shown in FIG. 1, will be fixed later to an ink discharge joint 92.

As shown as FIG. 4(*b*), a second plate 72 that is second from the top comprises a long narrow portion 72*a* that extends diagonally from a portion that corresponds to the round hole 71*a* formed in the first plate 71, a through hole 72*b* that is formed in a substantially parallelogram shape in approximately the central position of the second plate 72, and a long narrow hole 72*c* that extends diagonally toward the round hole 71*b* formed in the first plate 71. The through hole 72*b* forms an ink storage chamber that is positioned upstream of a filter 73*f* described below.

As shown in FIG. 4(*c*), a third plate 73 that is third from the top has a through hole 73*b* that is slightly smaller than the through hole 72*b*, in a position that corresponds to the through hole 72*b* formed in the second plate 72. A step 73*a* is formed in the upper edge of the through hole 73*b*, and the filter 73*f* that removes dirt and the like in the ink is provided on the step 73*a* (see FIG. 3). The filter 73*f* is fitted into the step 73*a*, and has a thickness that is substantially the same as the height of the step 73*a*. The upper surface of the filter 73*f* is on the same plane as the upper surface of the third plate 73. In addition, as shown in FIG. 4(*c*), a round hole 73*c* is formed in the third plate 73 in a position that corresponds to the long narrow hole 72*c* formed in the second plate 72. The round hole 73*c* corresponds to one end of the long narrow hole 72*c*, and the round hole 71*b* corresponds to the other end of the long narrow hole 72*c*.

As shown in FIG. 4(*d*), a through hole 74*a* is formed in a fourth plate 74 that is fourth from the top by press working or the like. The through hole 74*a* forms an ink storage chamber that is positioned downstream of the filter 73*f*. The planar shape of the through hole 74*a* extends along the X direction so as to curve and become tapered, and is symmetrical with respect to the center thereof. The through hole 74*a* that forms the downstream ink storage chamber includes a main passage 74*b* that extends in the X direction, and 8 branch passages 74*c* that branch from the main passage 74*b* and which have a passage width that is narrower than the main passage 74*b*. Each pair of branch passages 74*c* extends in the same direction. Two branch passages 74*c* that extend on the bottom left side extend from the bottom left side of the main passage 74*b*, two branch passages 74*c* that extend on the upper left side extend from the upper left side of the main passage 74*b*, two branch passages 74*c* that extend on the bottom right side extend from the bottom right side of the main passage 74*b*, two branch passages 74*c* that extend on the upper right side extend from the upper right side of the main passage 74*b*, and the main passage 74*b* extends in a position that corresponds to the round hole 73*c* of the third plate 73.

As shown in FIG. 3, the fifth plate 75 that is the fifth from the top is extremely thin compared to the other plates. As shown in FIG. 4(*e*), a total of 10 elliptical holes 75*a* are formed by means of etching etc. in the fifth plate 75. The elliptical holes 75*a* are formed in positions that correspond to both ends in the lengthwise direction of the main passage 74*b* that is formed by the fourth plate 74, and in positions that correspond to the tips of each branch passage 74*c*. Five elliptical holes 75*a* each are formed on both sides of the fifth plate 75 in the Y direction near both ends. A sequence of one elliptical hole 75*a*, two elliptical holes 75*a*, and two elliptical holes 75*a*, are provided on the upper edge in the Y direction from one end in the lengthwise direction (the left side of FIG. 4(*e*)). A sequence of one elliptical hole 75*a*, two elliptical holes 75*a*, and two elliptical holes 75*a*, are provided on the lower edge in the Y direction from one end in the lengthwise direction (the right side of FIG. 4(*e*)). A total of 10 elliptical holes 75*a* are formed in positions that avoid cut-outs 53*e*. The ten elliptical holes 75*a* are symmetrically provided with respect to the center of the plate.

As shown in FIG. 4(*f*), the sixth plate 76 of the lowermost layer has 10 elliptical holes 76*a* that correspond to the 10 elliptical holes 75*a* formed in the fifth plate 75, and a through hole 76*b* that corresponds to the main passage 74*b* of the fourth plate 74. The lower surface of the sixth plate 76 is formed by half-etching or the like so that only the peripheral portions of the elliptical holes 76*a* project downward (the portion surrounded by the dotted line in the figure), only the projecting portions thereof are fixed to the upper surface of the passage unit 4, and the portions thereof other than the projecting portions are isolated from the passage unit 4 (see FIG. 2).

As shown in FIG. 4(*a*)-(*f*), rectangular cut-outs 53*a*, 53*b*, 53*c*, 53*d*, 53*e*, 53*f* are formed in a staggered pattern in both sides in the Y direction of each plate 71-76. Two of each of the cut-outs 53*a*, 53*b*, 53*c*, 53*d*, 53*e*, 53*f* are formed on one side, for a total of 4. When the plates 71-76 are aligned together and stacked, recesses 53 are constructed (see FIG. 2) that run through the reservoir unit 70 in the vertical direction by means of these cut-outs 53*a*-53*f*. The width of the reservoir unit 70 is substantially the same as the width of the passage unit 4, excluding the recesses 53.

As shown in FIG. 3, the six plates 71-76 are stacked in an aligned state, and are fixed to each other.

Next, the ink flow within the reservoir unit 70 will be described. As shown in FIG. 3, an ink supply joint 91 is fixed to a position that connects with the round hole 71*a* of the upper surface of the first plate 71. An ink discharge joint 92 is fixed in a position that connects with the round hole 71*b* of the upper surface of the first plate 71. The joints 91, 92 are both cylindrical members having base ends 91*b*, 92*b* whose outer diameters are slightly larger, and the respective openings of the cylindrical spaces 91*a*, 92*a* in the lower surfaces of the base ends 91*b*, 92*b* are fixed in positional relationships that match the openings in each round hole 71*a*, 71*b* of the first plate 71. First, the flow of ink supplied from the ink supply joint 91 within the reservoir unit 70 will be described (the flow shown with the solid black arrows in FIG. 3), and the flow of the ink that is to be discharged from the reservoir unit 70 to the discharge joint 92 (shown with the hollow white arrows) will be described thereafter.

As shown with the solid black arrows in FIG. 3, the ink that has flowed through the cylindrical space 91*a* of the supply joint 91 and into the round hole 71*a* will flow into one end of the long narrow portion 72*a*, move horizontally from there, and will flow into the ink storage chamber 72*b* that is upstream of the filter 73*f*. Then the ink will pass through the filter 73*f*, and flow into the approximate central position of the ink storage chamber 74*a* that is downstream of the filter 73*f*. After that, as shown with the arrows in FIG. 4(*d*), the ink will move from the approximate center of the main passage 74*b* toward both ends in the lengthwise direction thereof, and toward the tips of each branch passage 74*c*. The ink that has reached both ends of the main passage 74*b* in the lengthwise direction, and the tips of each branch passage 74*c*, will flow through the elliptical holes 75*a*, 76*a*, and into 10 reception ports 5*b* (see FIG. 5) that are open on the upper surface of the passage unit 4.

The round hole 71*a* of the first plate 71 forms an ink introduction port of the ink jet head 1. The long hole 72*a* of the second plate 72 forms an common ink passage that introduces ink to the common ink storage chamber. The through hole 72*b* of the second plate 72 forms the common ink storage chamber that is upstream of the filter. The through hole 74*a* of the fourth plate 74 forms the common ink storage chamber that is downstream of the filter.

Next, the head body 1*a* will be described with reference to FIG. 2, FIG. 5, FIG. 6, FIG. 7, and FIG. 9. Note that in FIG. 6, the pressure chambers 10 and the apertures 12 that are below the actuator unit 21 should be drawn with broken lines, but are drawn with solid lines for ease of explanation.

As shown in FIG. 2 and FIG. 5, the head body 1*a* includes the passage unit 4, and four actuator units 21 that are fixed to the upper surface of the passage unit 4. The actuator units 21 select a pressure chamber 10 from the plurality of pressure chambers 10 formed in the upper surface of the passage unit 4, and pressurize the ink within the selected pressure chamber 10.

Figure 6:
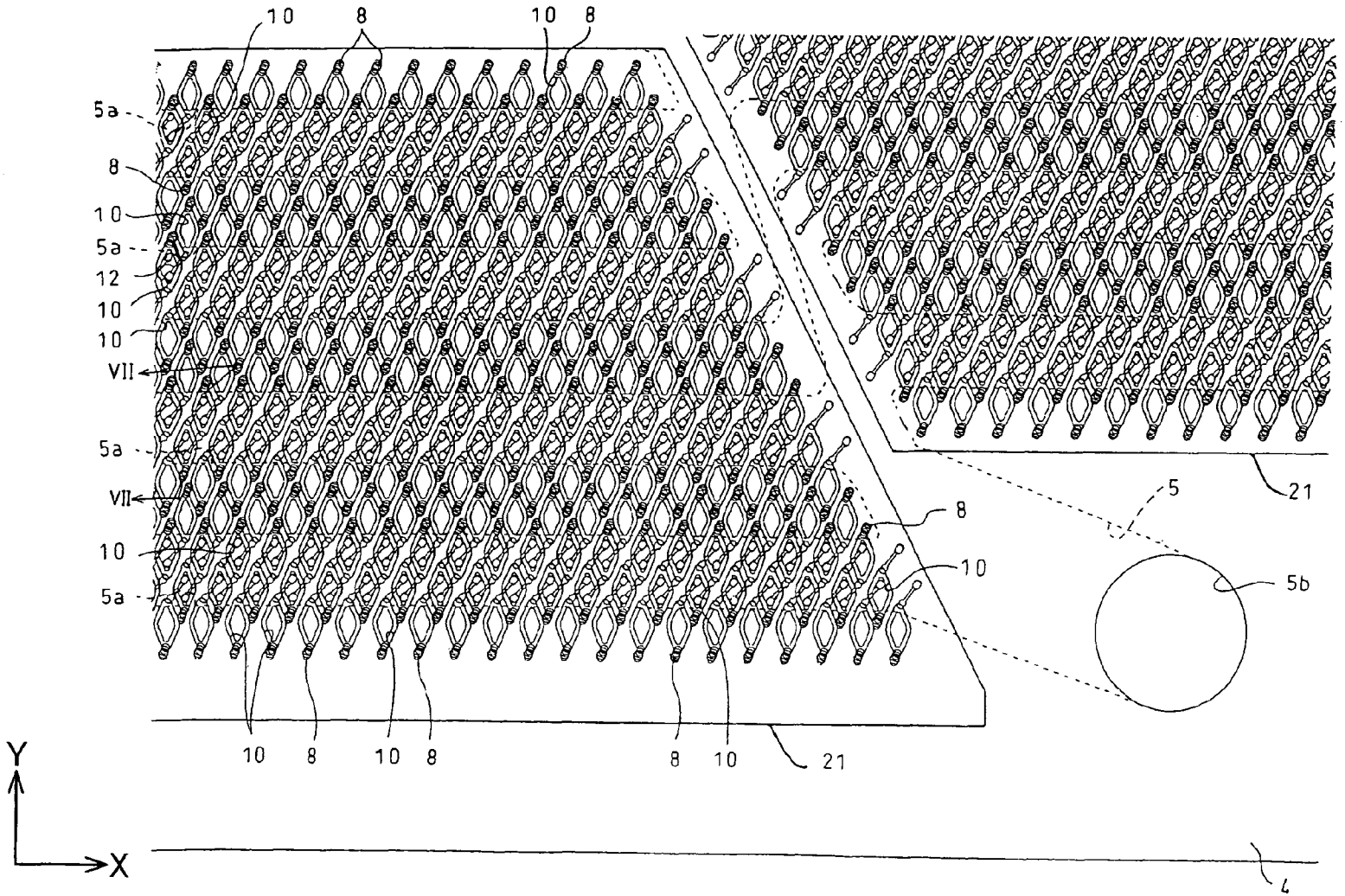
FIG. 6 is an expanded view of the region that is surrounded with the dotted line of FIG. 5.

First, the passage unit 4 will be described. As shown in FIG. 2, the passage unit 4 is substantially the same width as the reservoir unit 70, and as shown in FIG. 3, the length thereof in the X direction is slightly shorter than the reservoir unit 70. The passage unit 4 has a substantially rectangular shape. As shown in FIG. 5 and FIG. 6, an ink discharge area in which a plurality of nozzles 8 are provided in a matrix shape is formed in the lower surface of the passage unit 4. As shown in FIG. 5 and FIG. 6, a plurality of pressure chambers 10 are provided in a matrix shape in the upper surface of the passage unit 4. The number of nozzles 8 is equal to the number of pressure chambers 10. One nozzle 8 corresponds to one pressure chamber 10, and one pressure chamber 10 corresponds to one nozzle 8.

Figure 7:
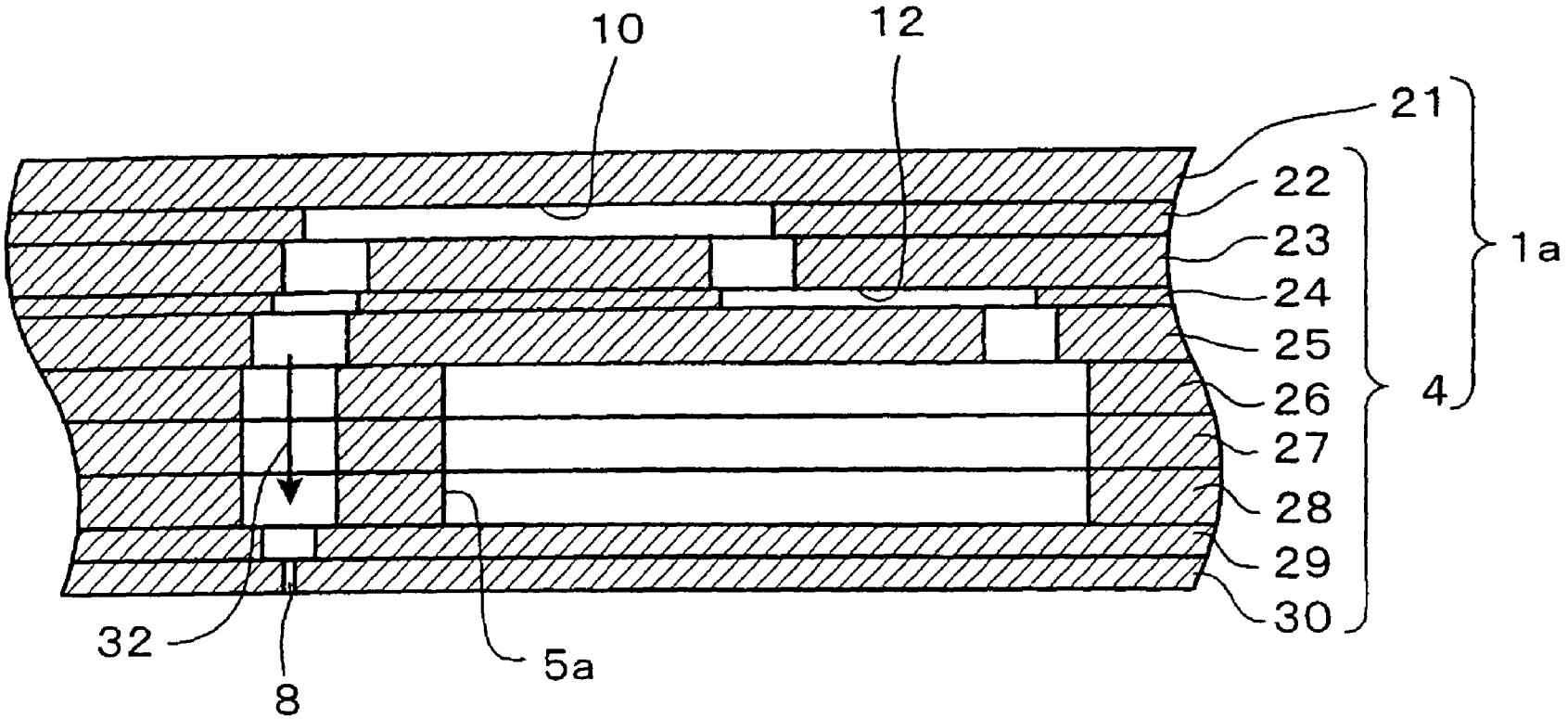
FIG. 7 is a cross-sectional view taken along line VII-VII of FIG. 6.
Figure 8:
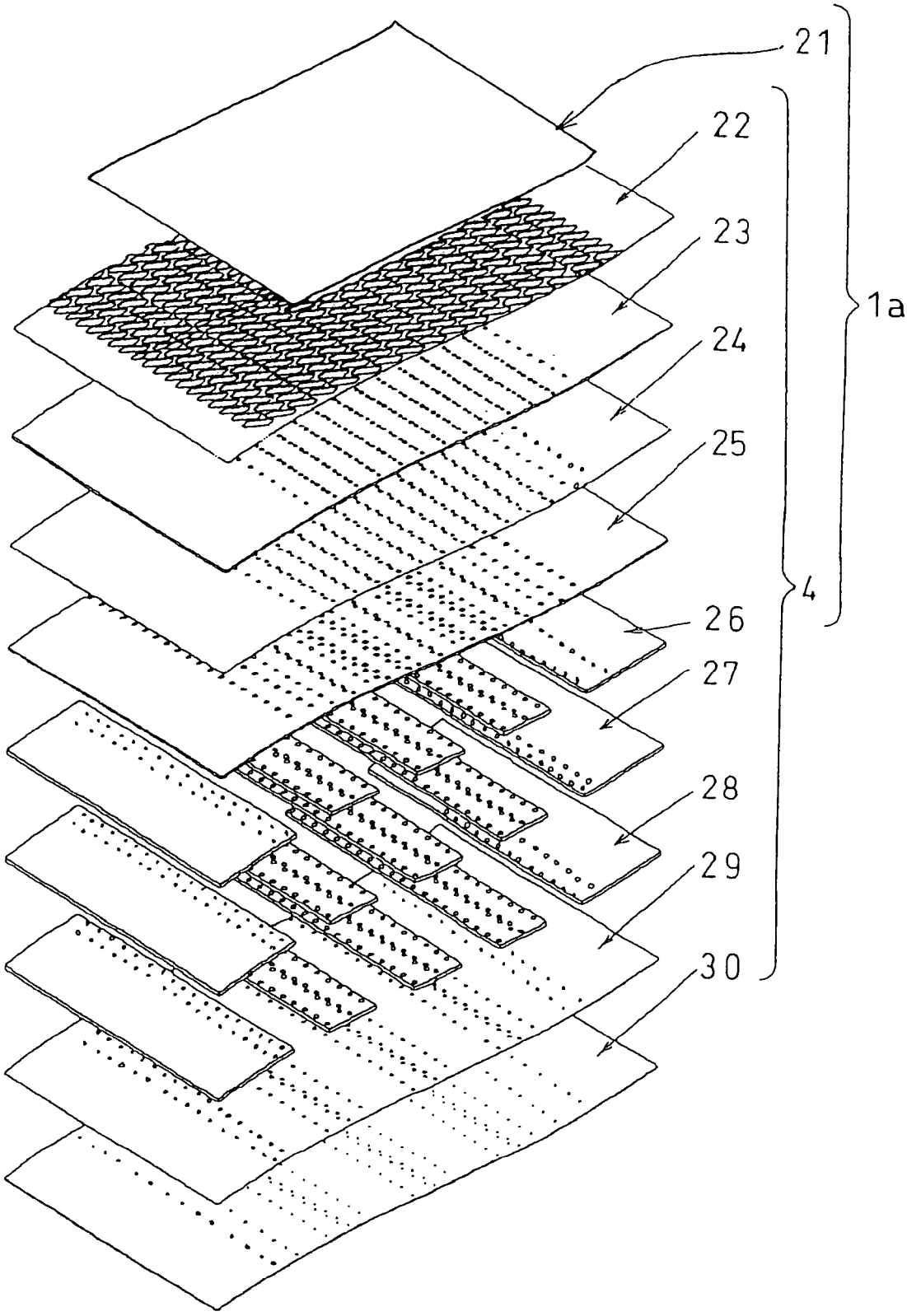
FIG. 8 is an oblique view of a portion of the head body shown in FIG. 1.

As shown in FIG. 7 and FIG. 8, the passage unit 4 is constructed from 9 metal plates, that are in sequence from the top, a cavity plate 22, a base plate 23, an aperture plate 24, a supply plate 25, manifold plates 26, 27, 28, a cover plate 29, and a nozzle plate 30. The plates 22-30 have long rectangular planes in the X direction (see FIG. 1).

As shown in FIG. 5, a total of 10 through holes that form the 10 reception ports 5*b*, and a large number of substantially rhombic through holes that form the pressure chambers 10, are formed in the cavity plate 22. As shown in FIG. 7, holes that connect each pressure chamber 10 with each actuator 12, and holes that connect each pressure chamber 10 with each nozzle 8, are formed in the base plate 23. Although not illustrated in FIG. 7, holes that connect the reception ports 5*b* with the manifold passages 5 are also formed in the base plate 23. Through holes that form the apertures 12 that connect with each pressure chamber 10, and holes that connect the pressure chamber 10 and the nozzle 8, are formed in the aperture plate 24. Although not illustrated in FIG. 7, holes that connect the reception ports 5*b* with the manifold passages 5 are also formed in the aperture plate 24. Holes that connect the apertures 12 with the sub-manifold passages 5*a*, and holes that connect the pressure chambers 10 with the nozzles 8, are formed in the supply plate 25. Although not illustrated in FIG. 7, holes that connect the reception ports 5*b* with the manifold passages 5 are also formed in the supply plate 25. Through holes that mutually connect when stacked and which construct the manifold passages 5 and the sub-manifold passages 5*a*, and holes that connect the pressure chambers 10 and the nozzles 8, are formed in the manifold plates 26, 27, 28. Holes that connect the pressure chambers 10 and the nozzles 8 are formed in the cover plate 29. Holes that form the nozzles 8 that connect with the pressure chambers 10 are formed in large numbers in the nozzle plate 30.

As shown in FIG. 7, nine plates 22-30 are aligned together, stacked, and fixed to each other so that individual ink passages 32 are formed within the passage unit 4 from the common manifold passages 5, through the apertures 12 and the pressure chambers 10, and to the nozzles 8. One individual ink passage 32 corresponds to one nozzle 8. Pressure chambers 10 that are equal in number to the number of nozzles 8, apertures 12 that are equal in number to the number of nozzles 8, and individual ink passages 32 that are equal in number to the number of nozzles 8, are prepared. One pressure chamber 10, one apertures 12, and one individual ink passage 32, correspond to one nozzle 8. A large number of recesses that form the pressure chambers 10 are exposed on the upper surface of the passage unit 4.

As shown in FIG. 5, the 10 reception ports 5*b* are open in positions that correspond to the 10 elliptical holes 76*a* (see FIG. 4(*f*)) of the reservoir unit 70 in the upper surface of the passage unit 4. The manifold passages 5 that connect with the reception ports 5*b*, and the sub-manifold passages 5*a* that branch from the manifold passages 5, are formed within the passage unit 4. For each nozzle 8, an individual ink passage 32 is formed from the sub-manifold passage 5*a*, through the pressure chamber 10, and to the nozzle 8. Ink that is supplied from the reservoir units 70 through the reception ports 5*b* to the inside of the passage unit 4 is branched from the manifold passages 5 to the sub-manifold passages 5*a*, and through the apertures 12 and pressure chambers 10, to the nozzles 8.

The manifold passages 5 are branched into 10 passages, and the sub-manifold passages 5*a* are branched into an even larger number of passages, but mutually connect within the reservoir unit 70. In other words, all of the manifold passages 5 and the sub-manifold passages 5*a* merge together in a downstream ink storage chamber 74*a*. The manifold passages 5 and the sub-manifold passages 5*a* are thickly formed so that a large quantity of ink will flow, and the pressure drop will be low. In other words, the pressure of the ink that is stored in the manifold passages 5 and the sub-manifold passages 5*a* is almost the same regardless of location. In contrast, the individual ink passages 32 are narrow, and the pressure drop is large. Because of this, the ink pressure may differ in each individual ink passage 32.

The manifold passages 5 and the sub-manifold passages 5*a* can act as an common ink storage space that commonly stores ink that is to flow to the plurality of individual ink passages 32.

A common upstream ink storage chamber 72*b* is formed within the reservoir unit 70, a first common downstream ink storage chamber 74*a* is formed within the reservoir unit 70, and second common downstream ink storage chambers 5, 5*a* are formed within the passage unit 4, and can be evaluated.

Next, the actuator units 21 will be described. As shown in FIG. 5, the planar shape of each actuator unit 21 is trapezoidal. Four actuator units 21 are fixed to the upper surface of the passage unit 4. The four actuator units 21 are provided in a staggered formation. The reception ports 5*b* are formed in positions that do not overlap with the four actuator units 21. The four actuator units 21 are fixed in positions that correspond to ink jet areas that are formed on the bottom surface of the passage unit 4. As noted above, a large number of nozzles are formed in the ink jet areas. A large number of recesses that respectively form the pressure chambers 10 are formed in the upper surface of the passage unit 4 that corresponds to the ink jet area. As shown in FIG. 7, one nozzle 8 corresponds to one recess 10. One actuator unit 21 extends along a plurality of recesses or pressure chambers, and caps each of the recesses. By capping the recesses with the actuator unit 21, the pressure chambers 10 will be formed.

Each actuator unit 21 is fixed so that the opposing parallel edges thereof extend along the lengthwise direction of the passage unit 4. The diagonal edges of adjacent actuator units 21 extend in parallel across a slight gap.

As shown in FIG. 2, the actuator units 21 are separated from the lower surface of the reservoir unit 70. A corresponding FPC 50 is fixed to the upper surface of each actuator unit 21. The FPCs 50 are inserted into the gap between the actuator units 21 and the reservoir unit 70.

Figure 9:
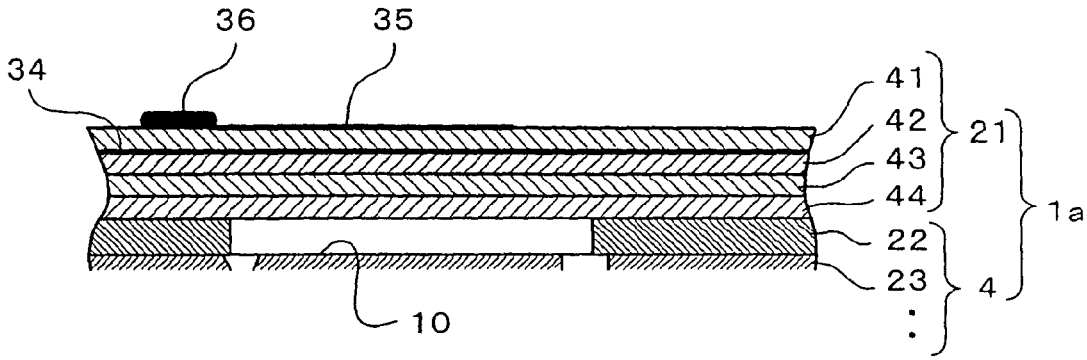
FIG. 9(*a*) is an enlarged cross-sectional view of an actuator unit shown in FIG. 7, and FIG. 9(*b*) is a plan view showing an individual electrode that is provided on a surface of the actuator unit.
Figure 9:
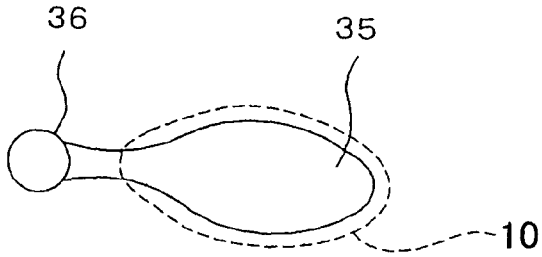

As shown in FIG. 9(*a*), the actuator units 21 are constructed from 4 piezoelectric sheets 41, 42, 43, 44 that are approximately 15 μm in thickness, and are composed of a lead zirconate titanate (PZT) type ceramic material having ferroelectric characteristics. The piezoelectric sheets 41-44 are fixed together.

A plurality of individual electrodes 35 are formed on the upper surface of the uppermost piezoelectric sheet 41. Each individual electrode 35 is formed in a position that corresponds to a recess that forms a pressure chamber 10.

A common electrode 34 of approximately 2 μm in thickness is interposed between the uppermost piezoelectric sheet 41 and the piezoelectric sheet 42 below, and formed on the entire surface of the sheet. The individual electrodes 35 and the common electrode 34 are composed of a metal material such as an Ag—Pd complex or the like. Electrodes are not provided between the piezoelectric sheets 42, 43, the piezoelectric sheets 43, 44, and on the lower surface of the piezoelectric sheet 44.

As shown in FIG. 9(*b*), the individual electrodes 35 have a thickness of approximately 1 μm, and have a substantially rhombic planar shape that resembles that of the pressure chambers 10. One end of the acute angle portions of the substantially rhombic individual electrodes 35 is extended, and round lands having a diameter of approximately 160 μm and electrically connected to the individual electrodes 35 are provided on the tip thereof. The lands 36 are composed of a metal that contains, for example, glass frit. The lands 36 are arranged in positions that do not overlap with the pressure chambers 10. The lands 36 are electrically bonded with the contact points provided on the FPCs 50 (see FIG. 2).

The common electrode 34 is grounded in an area that is not illustrated. In this way, the common electrode 34 is maintained in a uniform ground potential in the entire area that corresponds to the pressure chambers 10. On the other hand, the individual electrodes 35 are connected to the driver ICs 84 through the lands 36 that are independent of each individual electrode 35, and the FPCs 50 that are comprised of lead wires that are independent of each individual electrode 35 (see FIG. 2), so that the electric potential can be controlled independent from other individual electrodes 35.

For example, by employing screen printing technology, a large number of individual electrodes 35 can be formed at a high density on the piezoelectric sheet 41. Because of that, the pressure chambers 10 and the nozzles 8 that are formed in positions that correspond to the individual electrodes 35 can be provided at a high density. High resolution image printing can be performed.

Here, the method of driving the actuator units 21 will be described. When the piezoelectric sheet 41 is polarized in the thickness direction, makes the electric potential of the individual electrodes 35 different than the common electrode 34, and applies an electric field in the thickness direction of the piezoelectric sheet 41, the electric field application portion in the piezoelectric sheet 41 is deformed due to the piezoelectric effect. When an electric field is applied in the thickness direction of the piezoelectric sheet 41 that is polarized in the thickness direction, the piezoelectric sheet 41 will become thicker, and will contract within the planar surface On the other hand, the remaining three piezoelectric sheets 42-44 are non-active layers, and cannot naturally deform.

In other words, the actuator units 21 are a so-called unimorph type, in which the one piezoelectric sheet 41 that is furthest away from the pressure chambers 10 is the active layer, and the three piezoelectric sheets 42-44 on the side near the pressure chambers 10 are non-active layers. As shown in FIG. 9(*a*), the piezoelectric sheets 41-44 are fixed to the upper surface of the cavity plate 22 that forms the pressure chambers 10. The entirety of the piezoelectric sheets 41-44 will deform (unimorph deformation) so as to become convex on the pressure chambers 10 side, because the electric field application portion of the piezoelectric sheet 41 will warp, and the piezoelectric sheets 42-44 below will not warp. In this way, the volume of the pressure chambers 10 will decrease. The pressure applied to the ink within the pressure chambers 10 will rise, the ink will be pushed out from the pressure chambers 10 to the nozzles 8, and the ink will jet from the nozzles 8.

After that, when the individual electrodes 35 return to the same electric potential as the common electrode 34, the piezoelectric sheets 41-44 will take their original flat shape, and the volume of the pressure chambers 10 will return to their original volume. In accordance with this, ink will be introduced from the manifold passages 5 to the pressure chambers 10, and ink will be again stored within the pressure chambers 10.

By selecting the individual electrodes 35 that apply the voltages, the nozzles that will jet the ink can be selected. By controlling the timing at which the voltages are applied to the individual electrodes 35, the timing at which the ink is jetted from the nozzles can be controlled.

Next, the system that supplies ink from the ink supply joint 91 to the reservoir unit 70, and the system that discharges ink stored in the reservoir unit 70 from the ink discharge joint 92, will be described with reference to FIG. 10.

First, the system by which ink is supplied to the reservoir unit 70 will be described. An ink tank 101 is prepared on the exterior of the reservoir unit 70. The ink tank 101 and the ink supply joint 91 are connected by a tube 110. A pump 121 is interposed along the length of the tube 110. When the pump 121 rotates, as shown with the solid black arrow of FIG. 10, the ink will pass from the ink tank 101 to the pump 121, the tube 110, and the ink supply joint 91, and be supplied to the inside of the reservoir unit 70.

The pump 121 will first operate when the ink is to be supplied to the inside of the reservoir unit 70. A bypass passage is maintained inside the pump 121, and the ink can pass through the pump 121 when the pump 121 is not operating. The pump 121 is not operated during normal printing operations. When the actuator units 21 operate, and ink is jetted from the passage unit 4, negative pressure will be generated inside the passage unit 4, and that will be transmitted to the ink tank 101 through the reservoir unit 70 and the tube 110. Due to that negative pressure, the ink will be drawn out from the ink tank 101, and will be drawn into the reservoir tank 70 through the bypass passage within the pump 121, and the tube 110.

When observed in long time intervals, the ink quantity that is supplied to the combined unit of the reservoir unit 70 and the passage unit 4 (this is referred to as a body) will be equal to the ink quantity that is jetted from the body. However, the flow of ink may be slow, and when viewed in short time intervals, the supply quantity and the jetted quantity of the ink may not necessarily match. If there is a time period in which the supply quantity is greater than the jetted quantity, there will also be a time period in which the supply quantity is less than the jetted quantity. This will produce pressure fluctuations inside the body.

Next, the system by which ink is discharged from the reservoir unit 70 will be described. A tube 111 is connected to the ink discharge joint 92. A discharge valve 60 is connected to the tip of the tube 111. A plunger 65 is provided is provided adjacent to the discharge valve 60.

The tube 111 and the plunger 65 are provided on both sides of the discharge valve 60. The discharge valve 60 is switched between open and closed states by means of the up and down movement of the plunger 65. When the discharge valve is opened by means of the plunger 65, ink will be allowed to discharge from the reservoir unit 70. When the discharge valve is closed by means of the plunger 65, ink will be prevented from discharging from the reservoir unit 70. The tube 111 will be filled with ink. The tube 111 also forms a portion of the ink storage space. When the discharge valve 60 is opened by means of the plunger 65, as shown with the hollow white arrow of FIG. 10, the ink inside the reservoir unit 70 will pass through the discharge joint 92 and the tube 111, will pass through the passages inside the discharge valve 60 and the plunger 65, and will be discharged to a waste liquid tank 103.

During a so-called reverse purge, the ink inside the reservoir unit 70 will be discharged. A reverse purge means ejecting ink or cleaning ink from the nozzles 8 under pressure, and discharging ink from the ink jet head 1 after the ink has flowed in the direction opposite from the normal direction for normal printing operation. When a reverse purge is executed, the interior of the ink jet head 1 can be cleaned. In other words, foreign material such as dust, air bubbles, and the like that accumulate inside the ink jet head 1 can be removed.

During the execution of the reverse purge, the lower portion of the ink jet head body la is capped with a cap 200 (more particularly, the entire lower surface on which the nozzles 8 of the passage unit 4 are formed). Then, as shown with one dotted arrow in FIG. 10, cleaning ink inside a cleaning ink tank 102 will be ejected under pressure from the cap 200, and into the passage unit 4 of the head body 1*a* through the pump 122 and a branching valve 123.

The cleaning ink injected into the passage unit 4 will flow into the individual ink passages 32 shown in FIG. 7 in the opposite direction of the arrows. In other words, the cleaning ink will move from the nozzles 8, through the pressure chambers 10, the apertures 12, the sub-manifold passages 5*a*, and the manifold passages 5 shown in FIG. 5, and to the reception ports 5*b*. The cleaning ink will also flow from the reception ports 5*b* into the reservoir unit 70. As shown in FIG. 3, the cleaning ink that has flowed into the reservoir unit 70 will reach the elliptical holes 76*a*, the elliptical holes 75*a*, and the downstream ink storage chamber 74*a*. Furthermore, the cleaning ink will pass through the round hole 73*c*, the long narrow hole 72*c*, and the round hole 71*b*, will reach the discharge joint 92, and will be discharged from the discharge joint 92. At this time, the ink that is in the passage unit 4 and the reservoir unit 70 will be pushed by the cleaning ink and will be discharged together with the cleaning ink. The ink discharged from the reservoir unit 70 in this way and the cleaning ink will be discharged to the waste liquid tank 103 through the passage shown with the hollow white arrow in FIG. 10.

Ink will be filled from the round hole 73*c* facing the downstream ink storage chamber 74*a*, to the long narrow hole 72*c*, the round hole 71*b*, the discharge joint 92, the tube 111, and the discharge valve 60, and this will become a portion of the ink storage space that is prepared in the ink jet head 1. The ink storage space is also used as the ink discharge passage.

Figure 10:
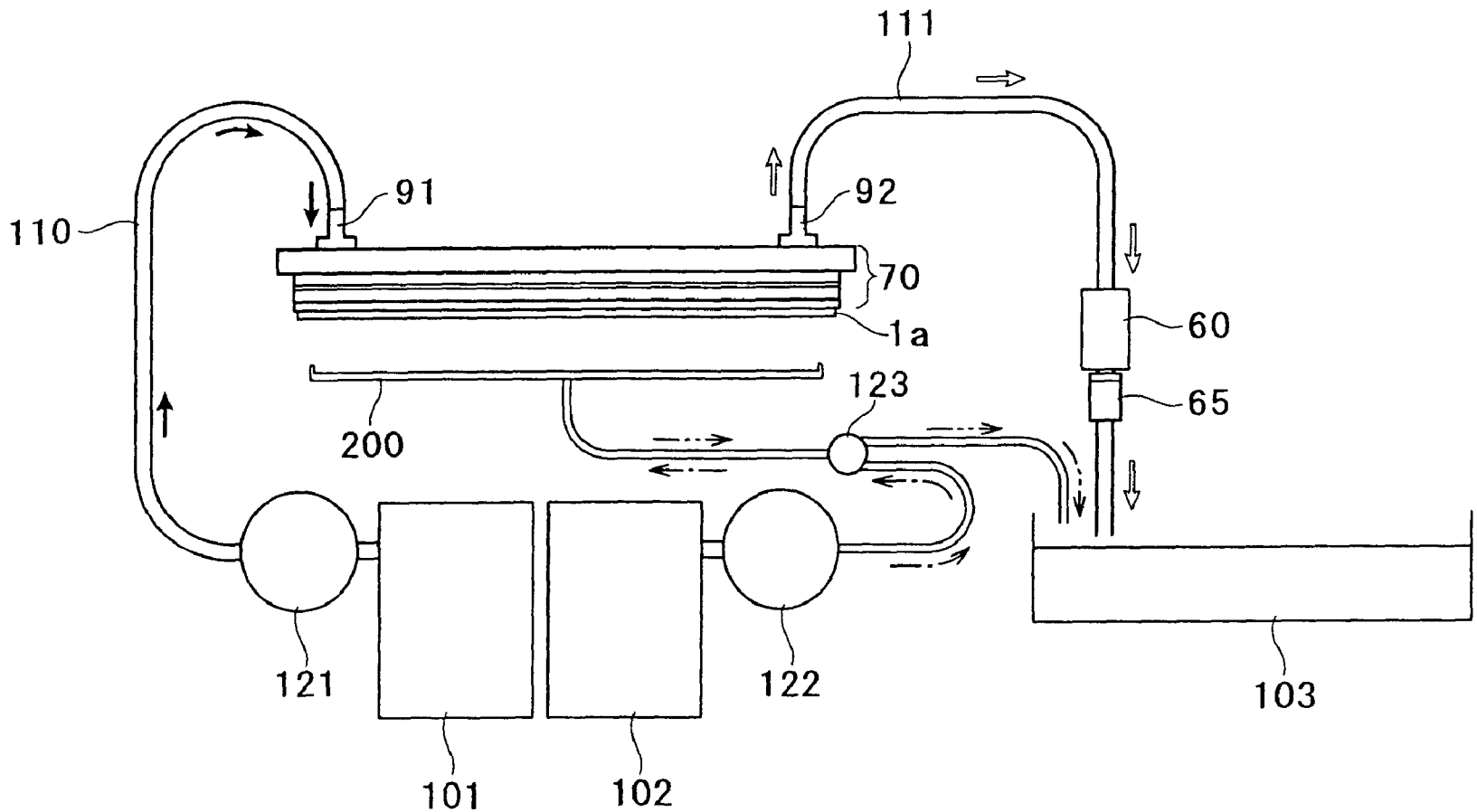
FIG. 10 is a schematic view showing an ink supply passage to the reservoir unit shown in FIG. 3, and an ink discharge passage from the reservoir unit.

The double dotted arrows in FIG. 10 show the flow of the ink during a purge. A purge is forcibly discharging ink contaminated with foreign matter inside the nozzles 8, and in this way ink discharge from the nozzles 8 will be maintained in a good condition. Purges include a pressure purge that pressurizes the ink inside the head 1, and a drawing purge that draws ink inside the head 1. Ink that is discharged from the nozzles 8 is received in the cap 200, and then is discharged to the waste liquid tank 103 via the branching valve 123. Note that a purge will be performed when ink is introduced from the ink tank 101 to the head 1 when a recording device that comprises the ink jet head 1 is used for the first time, and when the recording device is used again after not being used for a long period of time.

Next, the structure of the discharge valve 60 and the plunger 65 will be described with reference to FIG. 11.

Figure 11:
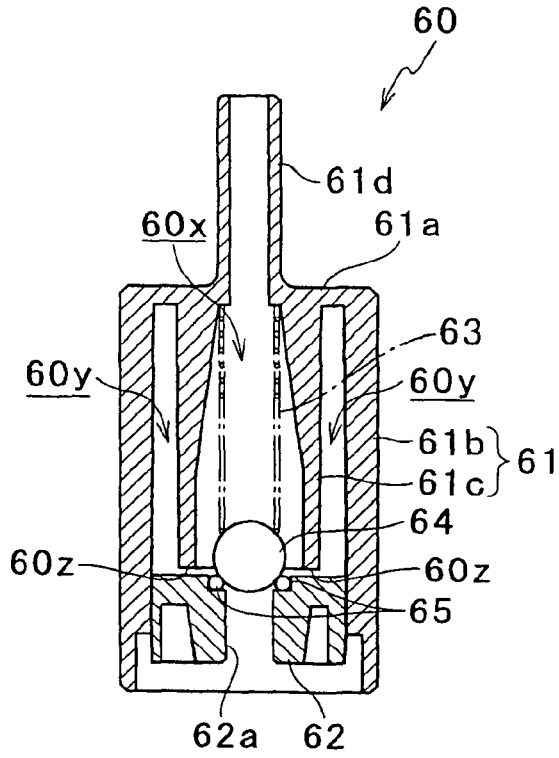
FIG. 11(*a*) is a vertical cross-sectional view of a discharge valve shown in FIG. 10, and FIG. 11(*b*) is a vertical cross-sectional view of a plunger shown in FIG. 10.
Figure 11:
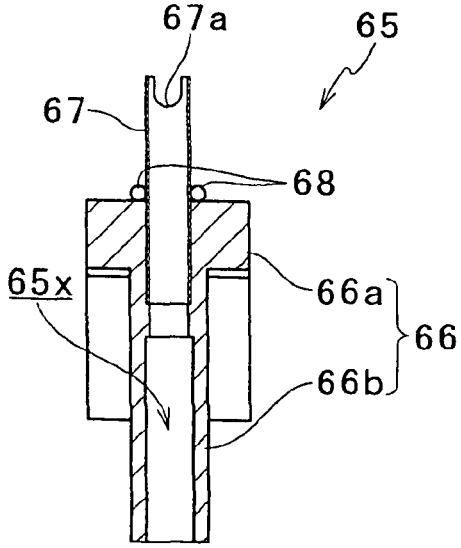

As shown in FIG. 11(*a*), the discharge valve 60 includes a valve body 61, and a cap 62 that fits on the lower portion of the valve body 61. The valve body 61 has a round flat upper wall 61*a* having a round hole in the center thereof, a tubular outer peripheral wall 61*b* and an inner peripheral wall 61*c* that extend downward from the upper wall 61*a*, and a tubular extension 61*d* that extends upward from the edge of the round hole of the upper wall 61*a*. A substantially column-shaped passage 60*x* is formed within the extension 61*d* and the inner peripheral wall 61*c*. The inner peripheral wall 61*c* tapers toward the upper end thereof, and thus the cross-section of the passage 60*x* will increase in size toward the lower end of the inner peripheral wall 61*c*. The cap 62 has a through hole 62*a* that passes therethrough in the direction in which the passage 60*x* extends.

An air chamber 60*y* that captures air is formed between the outer peripheral wall 61*b* and the inner peripheral wall 61*c*. The air chamber 60*y* is an annular shape that is provided around the passage 60*x*. The upper portion of the annular space of the air chamber 60y between the tubular outer peripheral wall 61*b* and the inner peripheral wall 61*c* is formed by sealing with the upper wall 61*a*.

A recess is formed in the edge of the through hole 62*a* in the upper surface of the cap 62 in order to provide an 0-ring 65. A ball valve 64 is provided on the O-ring 65, and a spring 63 is provided on the ball valve 64. The spring 63 is inside the passage 60*x* of the valve body 61, wound so as to have substantially the same tubular outer diameter as the extension 61*d*, and urges the ball valve 64 downward. In FIG. 11(*a*), the lower end of the passage 60*x* is sealed by the ball valve 64.

The air chamber 60*y* is connected through a gap 60*z* to the passage 60*x* that is closed by the ball valve 64. The gap 60*z* is the connection point between the air chamber 60*y* and the ink storage space 60*x*. The air chamber 60*y* extends upward from the gap 60*z*. In other words, the air chamber 60*y* extends from the gap 60*z* in a direction that is opposite to the flow of the ink downward toward the passage 60*x*. Because the air chamber 60*y* extends upward from the gap 60*z*, the ink cannot penetrate into the air chamber 60*y*. Because the air chamber 60*y* extends from the gap 60*z* in the direction that is opposite of the flow of ink, even if the ink flows, the ink cannot penetrate into the air chamber 60*y*. The air chamber 60*y* maintains an air within the ink that is fills the sealed space.

Captured air within the air chamber 60*y* is compressible, and the volume thereof is easily changed. If the pressure of the ink that fills the sealed space increases, the air that fills the air chamber 60*y* will be compressed, and the volume that the ink fills will increase. As a result, the pressure applied to the ink will be prevented from rising excessively. If the pressure of the ink that fills the sealed space decreases, the air that fills the air chamber 60*y* will expand, and the volume that the ink fills will decrease. As a result, the pressure applied to the ink will be prevented from decreasing excessively. The air that fills the air chamber 60*y* will effectively reduce the range of fluctuation of the pressure applied to the ink. This is referred to as a damper effect.

Only the gap 60*z* is between the air chamber 60*y* and the ink passage 60*x*, and there is no sheet that separates the air chamber 60*y* and the ink passage 60*x*. Even if there is no sheet, not only will ink not penetrate into the air chamber 60*y*, but air will not escape into the ink passage 60*x* either. A separation sheet is not necessary. When the separation sheet is not used, a phenomenon does not occur that the separating sheet adds resistance force against the free shift of the boundary between the air and the ink. The maximum damper effect can be obtained when the separation sheet is not used. However, a separation sheet may be used in accordance with need. The damper effect will be still obtained by the air chamber 60*y* so long as the separation sheet is flexible.

As shown in FIG. 11(*b*), the plunger 65 includes a plunger body 66, and a pipe 67 that is fitted on the upper portion of the plunger body 66. The plunger body 66 has an end wall 66*a* having a round hole in the center, and a pipe 66*b* that extends downward from the end wall 66*a*. A substantially column-shaped passage 65*x* is formed within the end wall 66*a* and the pipe 66*b*. The pipe 67 is fitted into the round hole in the center of the end wall 66*a*, and an O-ring 68 is provided on the outer periphery of the pipe.67 on the upper surface of the end wall 66*a*. Two cut-outs 67*a* are formed in the upper end of the pipe 67 (only one is shown in FIG. 11(*b*)).

Figure 12:
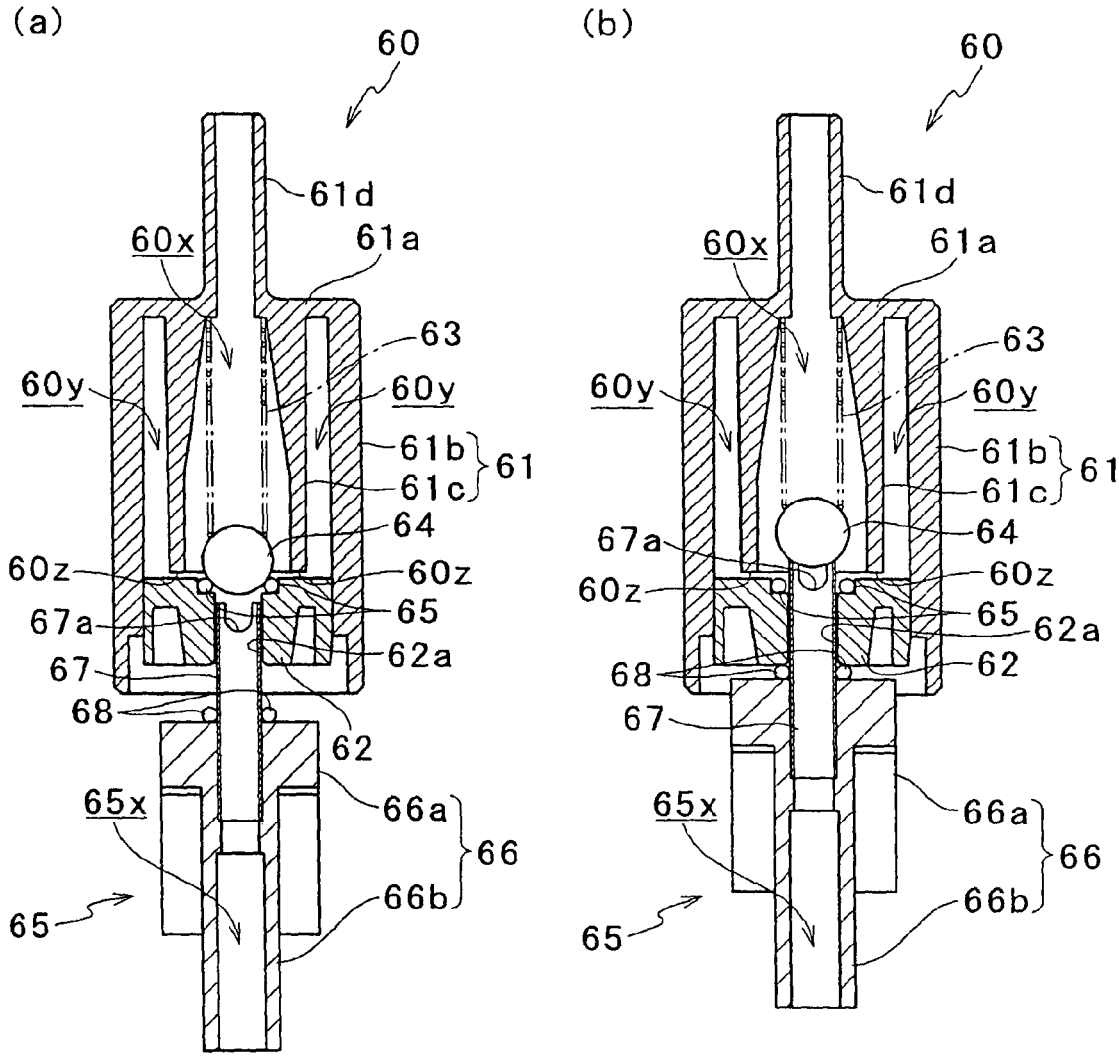
FIG. 12 show vertical cross-sectional views of the plunger inserted into a lower portion of the discharge valve, with FIG. 12(*a*) showing the plunger in the discharge prohibited position, and FIG. 12(*b*) showing the plunger in the discharge permitted position.

Next, the open/close operation of the discharge valve 60 by means of the plunger 65 will be described with reference to FIG. 12. FIG. 12 is a vertical cross-section showing the plunger 65 of FIG. 11(*b*) fitted into the lower portion of the discharge valve 60 of FIG. 11(*a*), with FIG. 12(*a*) showing the plunger 65 in the discharge prohibited position, and FIG. 12(*b*) showing the plunger 65 in the discharge permitted position.

As shown in FIG. 12(*a*), when the plunger 65 is in the discharge prohibited position, the upper end of the pipe 67 of the plunger 65 is inserted into the through hole 62*a* of the cap 62 of the discharge valve 60, and not yet in contact with the ball valve 64. At this time, the discharge valve 60 is closed because the lower end of the ink passage 60*x* inside the discharge valve 60 is sealed by the ball valve 64 that is urged downward by the spring 63.

When a reverse purge is performed, the plunger 65 is moved upward by a mechanism that includes an electromagnetic valve 130 described in detail below (see FIG. 13), and is placed in the discharge permitted position as shown in FIG. 12(*b*). In the movement stage, the upper end of the pipe 67 of the plunger 65 will come into contact with the ball valve 64, resist the urging force of the spring 63, and move the ball valve 64 upward. Then, the plunger 65 is stopped in the position in which the end wall 66*a* contacts the cap 62 of the discharge valve 60 through the O-ring 68.

As shown in FIG. 12(*b*), when the plunger 65 is in the discharge permitted position, the ink passage 60*x* inside the discharge valve 60 is connected to the passage 65*x* inside the plunger 65 through the cut-outs 67*a* formed in the upper end of the pipe 67. In this way, the reverse purge noted above can be performed.

Even when ink flows inside the passages 60*x*, 65*x*, ink will not penetrate into the air chamber 60*y*. In other words, even if a reverse purge is performed, the air inside the air chamber 60*y* will be maintained as is. This is because the air chamber 60*y* extends from the gap 60*z* that connects with the passage 60*x*, in the opposite direction of the flow of the ink inside the passage 60*x* during a reverse purge.

Figure 13:
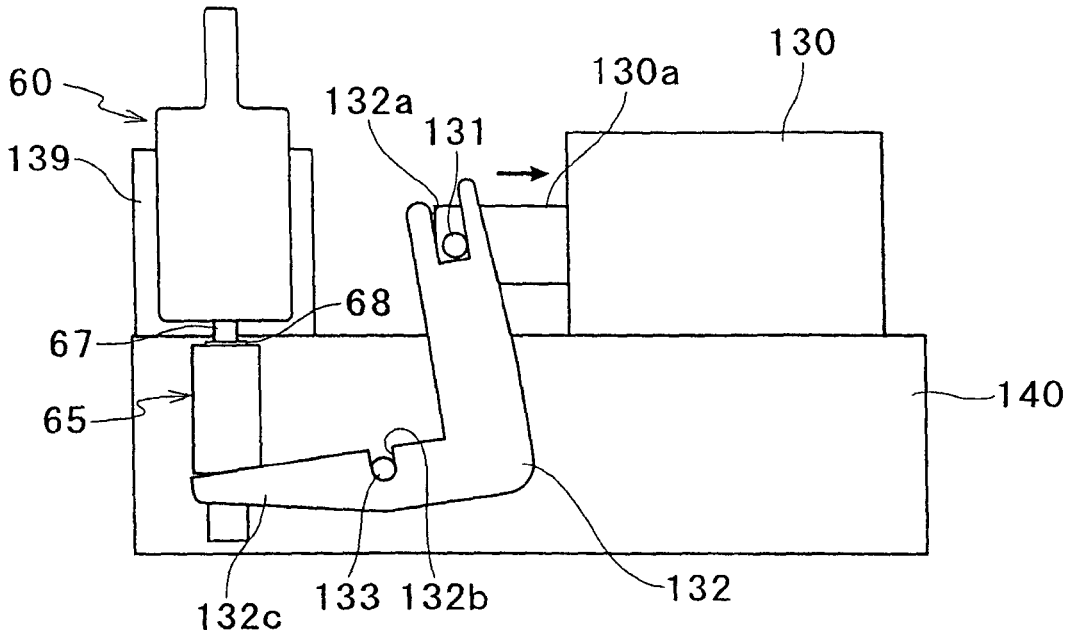
FIG. 13 is a schematic view showing the mechanism that moves the plunger up and down, with FIG. 13(*a*) showing the state that corresponds to FIG. 12(*a*), and FIG. 13(*b*) showing the state corresponding to FIG. 12(*b*).
Figure 13:
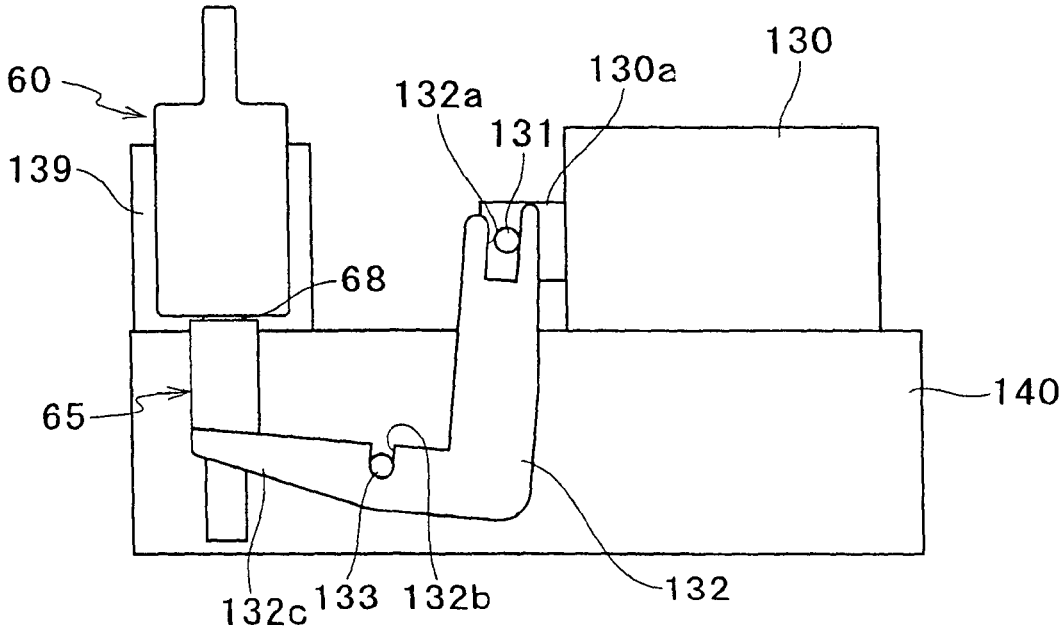

Here, the mechanism that moves the plunger 65 up and down will be described with reference to FIG. 13. FIG. 13(*a*) corresponds to FIG. 12(*a*), and FIG. 13(*b*) corresponds to FIG. 12(*b*).

A base 140 is provided in a recording device that is comprised of the ink jet head 1 of the present embodiment. A valve support unit is formed on the base 140. The discharge valve 60 is fixed on the valve support unit 139. The electromagnetic valve 130 is fixed to the upper surface of the base 140. The electromagnetic valve 130 has a slidable portion 130*a* that is fixed to one end of a shaft 131.

An L-shaped arm 132 is supported on a lateral surface of the base 140. The L-shaped arm 132 has a cut-out 132*b* formed in one end side from the bend, and a cut-out 132*a* formed on the other end. The shaft 133 is provided inside the cut-out 132*b*, and the L-shaped arm 132 is pivotably supported on the base 140 with the shaft 133 as the center thereof. On the other hand, the shaft 131 of the electromagnetic valve 130 is provided inside the cut-out 132*a* of the other end. The L-shaped arm 132 supports the plunger 65 on one end 132*c*.

When the slidable portion 130*a* of the electromagnetic valve 130 slides left and right, the other end 132*a* of the L-shaped arm 132 will also move, in accordance with the movement of the shaft 131. In this way, the L-shaped arm 132 will pivot about the shaft 133, and the plunger 65 supported on the one end 132*c* of the L-shaped arm 132 will move up and down.

In FIG. 13(*a*), by placing the plunger 65 in the discharge prohibited position described above, and sliding the slidable portion 130*a* in the direction of the arrow toward the interior of the electromagnetic valve 130 to pivot the L-shaped arm 132 in the clockwise direction in the drawing, the state shown in FIG. 13(*b*), i.e., the state in which the plunger 65 is in the discharge permitted position described above, can be achieved.

With the ink jet head 1 according to the present embodiment, a quantity of ink can only be supplied from the ink tank 101 in accordance with the jetted quantity of ink, and thus the ink volume inside the ink jet head 1 may temporarily decrease. In contrast, excess ink may attempt to flow from the ink tank 101 into the ink jet head 1. Due to this, the pressure applied to the ink inside the ink jet head 1 will fluctuate.

With the ink jet head 1 of the present embodiment, if the pressure of the ink inside the ink jet head 1 increases, the air that fills the air chamber 60*y* will compress, and the volume that the ink fills will increase. As a result, the pressure applied to the ink will be prevented from rising excessively. If the pressure of the ink inside the ink jet head 1 decreases, the air that fills the air chamber 60*y* will expand, and the volume that the ink fills will decrease. As a result, the pressure applied to the ink will be prevented from decreasing excessively. Because an air chamber 60*y* is prepared that is connected to the common ink storage space inside the ink jet head 1, changes in the pressure applied to the ink inside the ink jet head 1 will be effectively smoothed, and pressure fluctuations will be controlled.

Due to the damper effect by the air chamber 60*y* that is connected to the common ink storage space, the pressure applied to the ink will be prevented from rising excessively and decreasing excessively, and thus the phenomenon in which ink will ooze from the nozzles, or in which ink is drawn inside the nozzles, can be prevented. Stable quantities of jetted ink can be maintained.

The air chamber 60*y* for obtaining the damper effect is formed on the exterior of the body that is a combination of the passage unit 4 and the reservoir unit 70. Therefore, the construction of the body can be simplified. The air chamber 60*y* may also be formed inside the body.

In the present embodiment, the air chamber 60*y* is connected to the ink discharge passage. The air chamber 60*y* may be connected to the upstream ink storage chamber 72*b*, and may be connected to the downstream ink storage chamber 74*a*. The air chamber 60*y* may be connected anyplace from the ink introduction port 71*a* to the sub-manifolds 5*a*.

In the present embodiment, the fifth plate 75 that is a portion of the wall that defines the downstream ink storage chamber 74*a* of the reservoir unit 70 is extremely thin, and can deform in response to the pressure inside the ink jet head 1. As shown in FIG. 4(*e*), (*f*), the fifth plate 75 can easily deform up and down because the through hole 76*b* is formed in the sixth plate 76. The extremely thin fifth plate 75 is also used as an adjustor that will allow the volume of the downstream ink storage chamber 74*a* to change.

In the present embodiment, the air chamber 60*y* operates as a first adjustor, and the extremely thin fifth plate 75 operates as a second adjustor. Because two adjustors are prepared, the pressure fluctuations produced inside the ink jet head 1 can be effectively controlled or suppressed.

When the ink jet head 1 comprises a tube 111 and the like that extends outside the body, an adjustor that allows the volume of the ink storage space to change can be formed by forming the tube 111 or a portion thereof with a resilient material.

In the present embodiment, by providing the discharge valve 60, when one wants to remove foreign matter such as dust, air bubbles, and the like that are in the ink jet head 1, the ink inside the head 1 can be easily discharged by opening the lower end of the ink passage 60*x* with the discharge valve 60.

Because the discharge valve 60 is a construction having the ball valve 64 that can seal the lower end of the ink passage 60*x*, and the spring 63 that will urge the ball valve 64 downward, a discharge valve 60 construction that is simplified and lower in manufacturing cost can be achieved.

Note that a supply valve is preferably provided between the pump 121 shown in FIG. 10 and the ink supply joint 91. When a reverse purge is performed with the supply valve in the closed state, the ink flow will become smoother. Thus, the ink inside the head 1 can be more efficiently discharged.

The reservoir unit 70 has the filter 73*f* that divides the upstream ink storage chamber 72*b* and the downstream ink storage chamber 74*a*. In the present embodiment, the discharge path is connected to the downstream ink storage chamber 74*a*. Because foreign matter in the downstream ink storage chamber 74*a* can be discharged, the foreign matter can be prevented from moving to the passage unit 4 and causing poor ink discharge. Instead of this, the discharge chamber may be connected to the upstream ink storage chamber 72*b*. In this situation, the filter 73*f* can be cleaned because cleaning ink will reverse flow through the filter 73*f*.

In the present embodiment, the air chamber 60*y* that achieves the damper effect, and the extremely thin fifth plate 75, control fluctuations in the pressure of the ink stored in the downstream ink storage chamber 74*a*. At the front and rear of the filter 73*f*, a pressure drop will be generated by the comparatively large passage resistance of the filter 73*f*, and thus the pressure at the front and rear of the filter 73*f* will not match. When the pressure fluctuations of the downstream ink storage chamber 74*a* of the filter 73*f* are smoothed, the pressure of the individual ink passages will be even more smoothed. However, when the pressure fluctuations of the ink storage chamber 74*b* that is upstream of the filter 73*f* are smoothed, the pressure of the individual ink passages will be smoothed.

Second Embodiment

Next, the second embodiment will be described. The ink jet head of the present embodiment has a damper passage pipe 160 shown in FIG. 14 installed on the discharge tube 111 shown in FIG. 10. The other points thereof are identical with the first embodiment. Thus, only the construction of the damper passage pipe 160 will be described below. Note that in this situation, the discharge valve 60 need not have the air chamber 60*y*.

Figure 14:
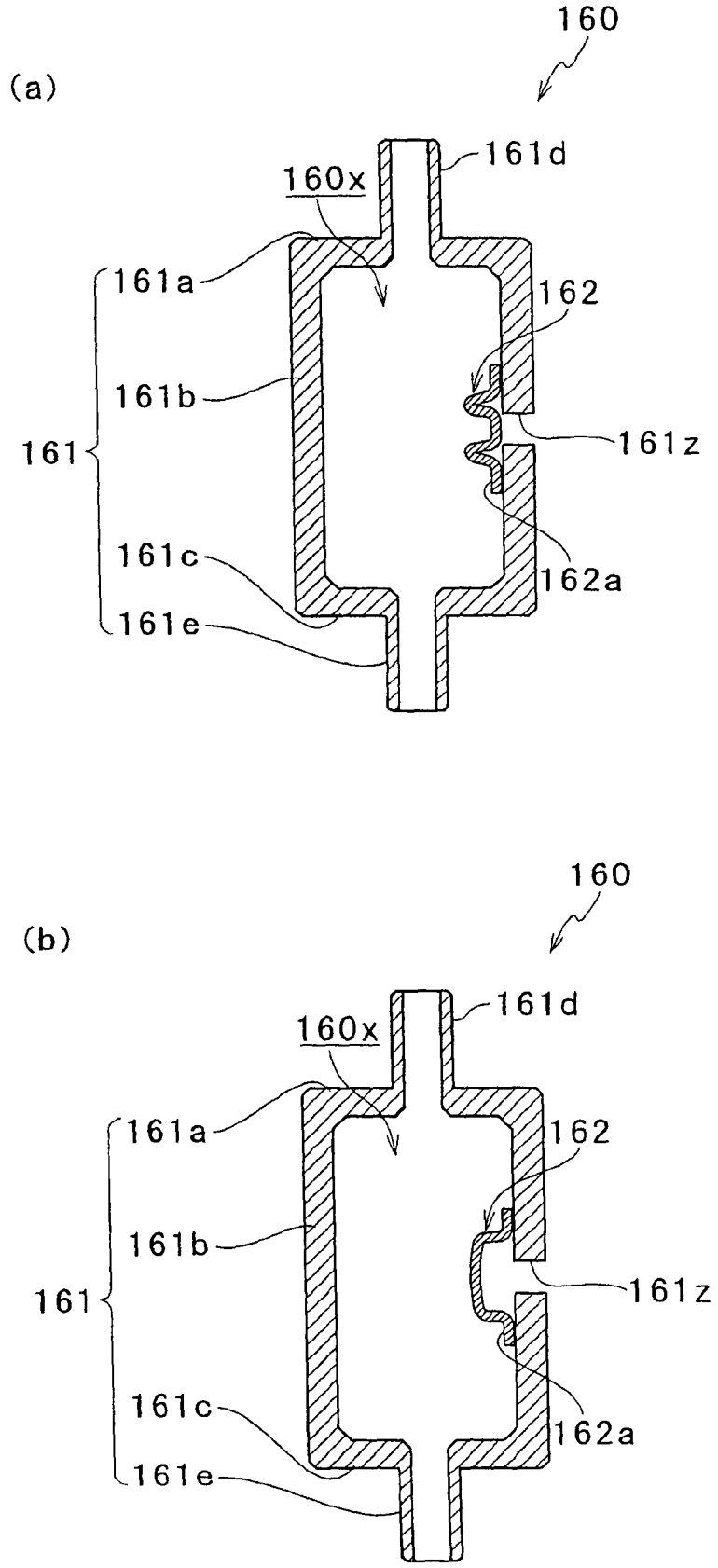
FIG. 14(*a*) and FIG. 14(*b*) are vertical cross-sectional views that show a second embodiment of a damper passage line that is installed on a discharge tube shown in FIG. 10.

As shown in FIG. 14(*a*), the damper passage pipe 160 includes a pipe body, and a damper sheet 162 that is composed of a thin, flexible sheet material that is installed on the pipe body 161. The pipe body 161 has a round and flat upper wall 161*a* and lower wall 161*c* that have a round hole in the centers thereof, a tubular peripheral wall 161*b* that is connected with the outer peripheral edges of the upper wall 161*a* and the lower wall 161*c* on the upper end and lower end thereof, an tubular upward extending portion 161*d* that extends upward from the edge of the round hole of the upper wall 161*a*, and a tubular downward extending portion 161*e* that extends downward from the edge of the round hole of the lower wall 161*c*. A substantially circular hole 161*z* is formed in the peripheral wall 161*b*, and the passage 160*x* inside the damper path pipe 160 connects with the atmosphere through the hole 161*z*.

The damper sheet 162 is installed on the inner surface of the peripheral wall 161*b* so as to cap the opening of the hole 161*z*, and is interposed between the ink inside the passage 160 and the atmosphere. More particularly, the damper sheet 162 has a circular flat surface that is slightly larger than the hole 161*z*, and only the peripheral edge 162*a* is fixed to the peripheral wall 161*b* to surround the hole 161*z*.

During a reverse purge as described above, the portion of the damper sheet 162 other than the edge 162*a* projects, as shown in FIG. 14(*a*), on the inner side of the passage 160*x*, and in this situation forms two convex portions. The inside of the passage 160*x* is filled with ink at this time, and an excessively negative pressure is not produced inside the head 1. On the other hand, when a negative pressure is produced inside the head 1, the portion of the damper sheet 162 that projects on the inner side of the passage 160*x* will be pulled further inward and, as shown in FIG. 14(*b*), will deform so as to form one convex portion.

As described above, with the ink jet head according to the present embodiment, even if the ink volume decreases inside the ink jet head 1 in accordance with the jetting of the ink, because the damper sheet 162 will deform in response to the pressure inside the ink jet head 1, control of the pressure fluctuations produced inside the ink jet head 1 and stable jetting of the ink can be achieved, and are the same effects as those of the first embodiment described above.

Moreover, because the damper sheet 162 is installed on the inner surface of the peripheral wall 161*b* rather than the outer surface, a compact damper passage pipe 160 will be achieved. In addition, because the damper sheet 162 is positioned inside the passage 160*x*, the problem of the damper 162 composed of a thin sheet material being damaged will be reduced, even if it is deformed in accordance with the pressure fluctuations inside the ink jet head 1. The peripheral wall 161*b* also functions as a limiter that limits the maximum deformation of the damper sheet 162.

The damper sheet 162 may also be fixed to the outer surface of the peripheral wall 161*b*.

Third Embodiment

Next, the third embodiment will be described with reference to FIG. 15 and FIG. 16. The ink jet head of the present embodiment differs from the first embodiment only in the construction of the reservoir unit 170. The other portions thereof are the same as the first embodiment. Only the construction of the reservoir unit 170 will be described below. Note that in this situation, the discharge valve 60 need not have the air chamber 60*y*. In addition, for ease of explanation, the scale in the vertical direction in FIG. 15 is increased, and ink passages that are not visible in the same cross-section are shown as needed.

Figure 16:
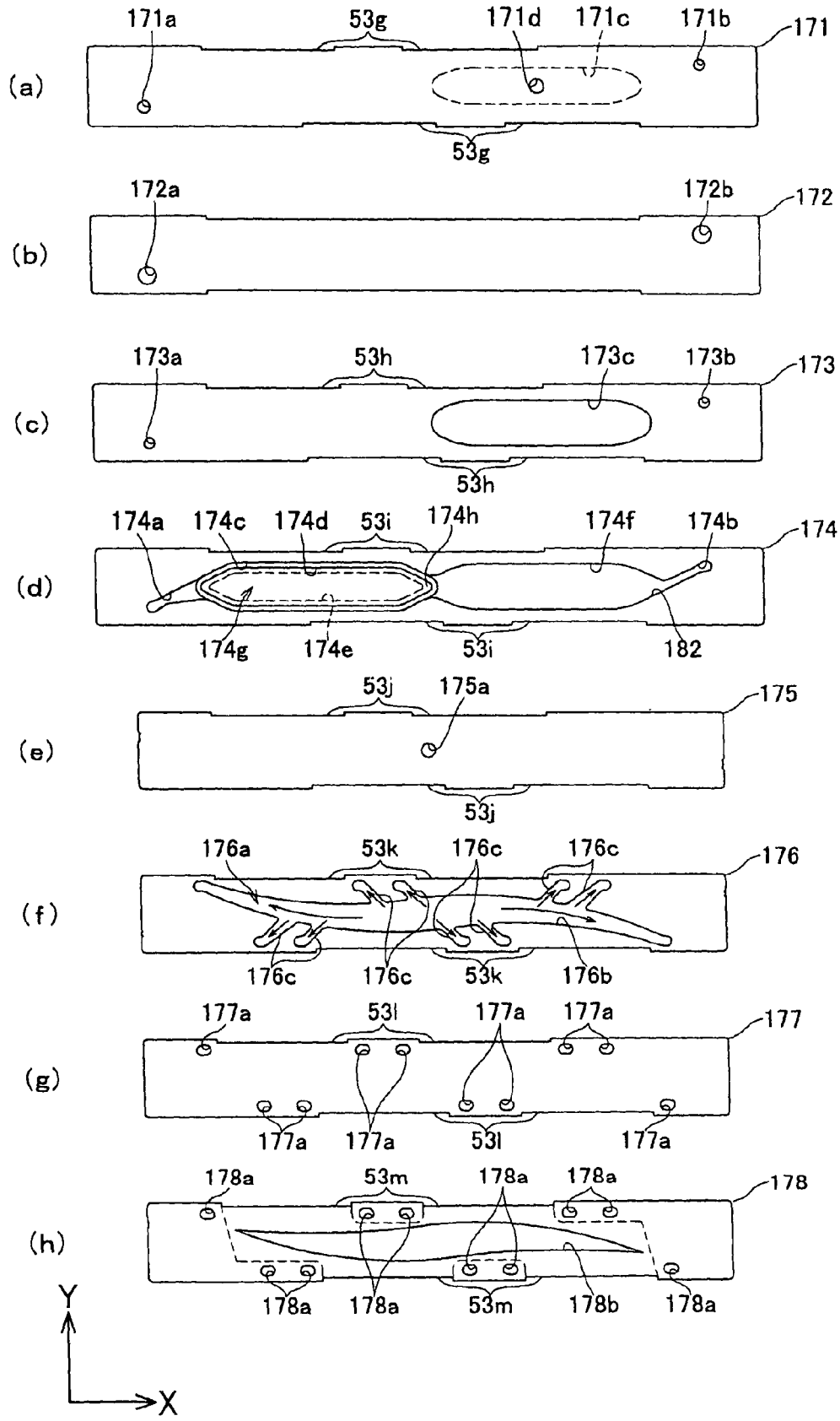
FIG. 16(*a*) to FIG. 16(*h*) show plan views of plates constructing the reservoir unit of the third embodiment.

As shown in FIGS. 16(*a*), (*b*), (*c*), (*d*), (*e*), (*f*), (*g*), and (*h*), the reservoir unit 170 is formed by stacking eight plates 171, 172, 173, 174, 175, 176, 177, 178 that have long square planar surfaces in the X direction. One plate 172 of eight plates is made of flexible sheet and works as a damper sheet.

Figure 15:
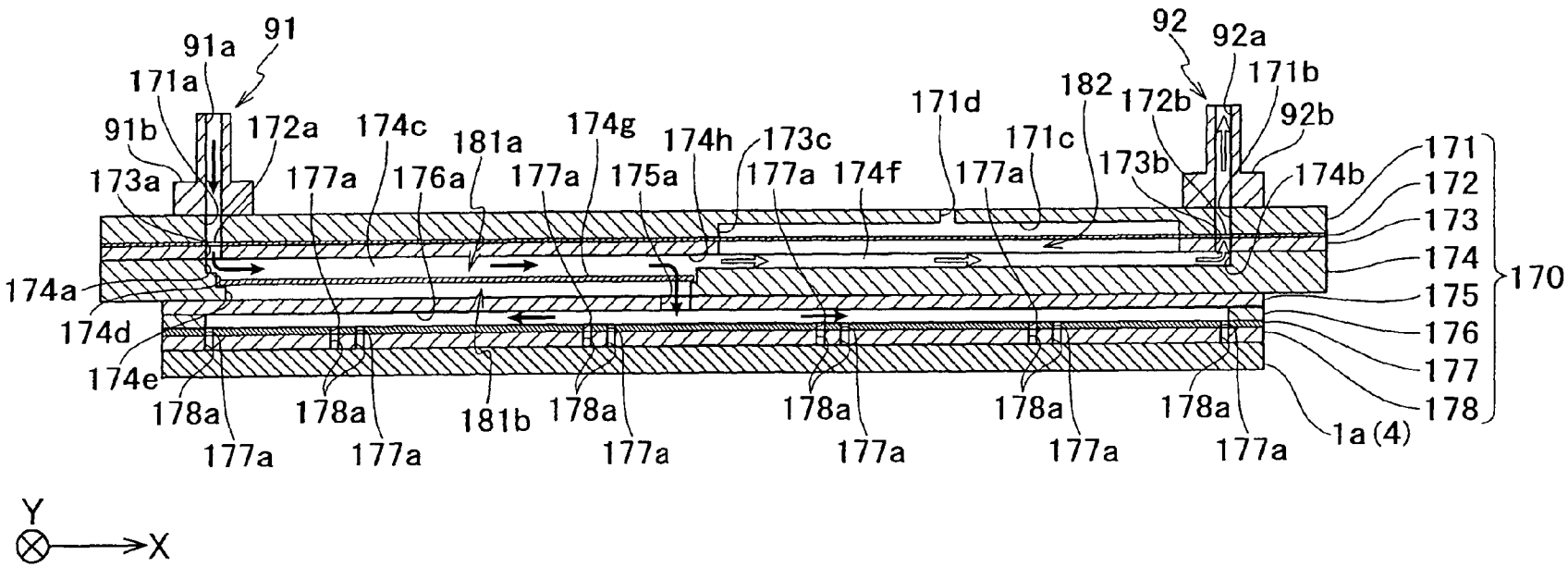
FIG. 15 is a cross-sectional view of a reservoir unit and a head unit that form a portion of an ink jet head of a third embodiment.

As shown in FIG. 15 and FIG. 16, the first plate 171 that is the uppermost layer has a round hole 171*a* formed near one end in the lengthwise direction of the first plate 171, and a round hole 171*b* formed near the other end. The round hole 171*a* is positioned eccentrically below the center of the first plate 171 in the Y direction, and the round hole 171*b* is positioned eccentrically above the center of the first plate 171 in the Y direction. In addition, a long elliptically shaped recess 171*c* that extends in the X direction is formed in the lower surface of the first plate 171 (the surface on the damper sheet 172 side). The recess 171*c* is positioned between the central position in the X direction of the first plate 171, and the round hole 171*b*. Furthermore, a round hole 171*d* is formed in the bottom center of the recess 171*c*. In other words, the elliptically shaped recessed 171*c* is formed in the lower surface side of the first plate 171, and the round hole 171*d* is formed so as to pass through the bottom of the recess 171*c* and the upper surface of the first plate 171.

A damper sheet 172 that is second from the top is composed of a thin flexible sheet material, and as shown in FIG. 15 and FIG. 16(*b*), round holes 172*a*, 172*b* are formed in positions that correspond to the round holes 171*a*, 171*b* formed in the first plate 171. Note that the thin flexible sheet material may be one that easily bends in response to the pressure fluctuations in the ink, and may be metal or resin. In the present embodiment, a compound sheet made from resin is employed, in which a gas barrier sheet is provided on PET (polyethylene terephthalate) having good gas barrier characteristics. In this way, the transmission of air or vapors through the thin flexible sheet can be controlled. Because the sheet is flexible, it can also function well as a damper that controls the pressure fluctuations of the ink.

As shown in FIG. 15 and FIG. 16(*c*), the third plate 173 that is third from the top has round holes 173*a*, 173*b* that are formed in and pass through positions that correspond to the round holes 171*a*, 171*b* formed in the first plate 171, and the elliptical hole 173*c* that corresponds to the elliptical recess 171*c* formed in the first plate 171.

As shown in FIG. 15 and FIG. 16(*d*), the fourth plate 174 that is fourth from the top has long narrow recesses 174*a*, 174*b* formed on a top surface. The recesses 174*a*, 174*b* extend diagonally from positions that correspond to the round holes 171*a*, 171*b* of the first plate 171, toward the center of the fourth plate 174 in the X and Y direction. In addition, an elliptical recess 174*c* that connects with the long narrow recess 174*a* is formed on the top surface. The recess 174*c* extends to the center of the fourth plate 174. Further an elliptical recess 174*f* is formed on the top surface of the fourth plate 174. The recess 174*f* connects with the long narrow recess 174*b* and extends to the center of the fourth plate 174. The elliptical recess 174*f* is formed in a concave shape, has an outer shape and size that is substantially the same as the elliptical hole 173*c* of the third plate 173, and is open on the third plate 173 side. In addition, a damper connection port 174*h* is formed near the center of the fourth plate 174. The elliptical recess 174*c* and the elliptical recess 174*f* are mutually connected via the damper connection port 174*h*. On the other hand, an elliptical recess 174*d* that is slightly smaller than the elliptical recess 174*c* is formed in the bottom center of the elliptical recess 174*c*. Furthermore, a through hole 174*e* that is further slightly smaller than the elliptical recess 174*d* is formed in the bottom center of the elliptical recess 174*d*. A filter 174*g* that removes dirt and the like that is in the ink is provided on a step that is a part of the upper edge of the through hole 174*e*. Here, the long narrow portion 174*a*, the elliptical recess 174*c*, and the elliptical recess 174*d* form an common ink storage chamber 181*a* that is upstream of the filter 174*g*. In addition, the elliptical recess 174*f* and the long narrow recess 174*b* form the damper chamber 182. The damper chamber 182 referred to here is a chamber that functions to allow changes in volume, and to smooth out the changes in the pressure applied to the ink.

As shown in FIG. 15 and FIG. 16(*e*), the fifth plate 175 that is the fifth from the top has a round hole 175*a* that is formed in the center thereof. Note that the fifth plate 175 is stacked from below so that the round hole 175*a* connects with the through hole 174*e* of the fourth plate 174. In addition, the round hole 175*a* faces the center acute angular portion of the through hole 174*e* of the fourth plate 174.

As shown in FIG. 15 and FIG. 16(*f*), the sixth plate 176 that is the sixth from the top has a through hole 176*a* that is formed therein. The planar shape of the through hole 176*a* extends along the X direction so as to curve and become tapered, and is symmetrical with respect to the center thereof. The through hole 176*a* that forms the downstream ink storage chamber includes a main passage 176*b* that extends in the X direction, and 8 branch passages 176*c* that branch from the main passage 176*b* and which have a passage width that is narrower than the main passage 176*b*. Each pair of branch passages 176*c* extends in the same direction. The two branch passages 176*c* that extend on the lower left side extend from the lower left side of the main passage 176*b*, the two branch passages 176*c* that extend on the upper left side extend from the upper left side of the main passage 176*b*, the two branch passages 176*c* that extend on the lower right side extend from the lower right side of the main passage 176*b*, and the two branch passages 176*c* that extend on the upper right side extend from the upper right side of the main passage 176*b*.

As shown in FIG. 15, the seventh plate 177 that is the seventh from the top is extremely thin compared to the other plates. As shown in FIG. 16(*g*), a total of 10 elliptical holes 177*a* are formed by means of etching etc. in the fifth plate 177. The elliptical holes 177*a* are formed in positions that correspond to both ends in the lengthwise direction of the main passage 176*b* that is formed by the sixth plate 176, and in positions that correspond to the tips of each branch passage 176*c*. Five elliptical holes 177*a* each are formed on both sides of the seventh plate 177 in the Y direction near both ends. A sequence of one elliptical hole 177*a*, two elliptical holes 177*a*, and two elliptical holes 177*a*, are provided on the upper edge in the Y direction from one end in the lengthwise direction (the left side of FIG. 16(*g*)). A sequence of one elliptical hole 177*a*, two elliptical holes 177*a*, and two elliptical holes 177*a*, are provided on the lower edge in the Y direction from one end in the lengthwise direction (the right side of FIG. 16(*g*)). A total of 10 elliptical holes 177*a* are formed in positions that avoid cut-outs 53*g*. The ten elliptical holes 177*a* are symmetrically provided with respect to the center of the plate.

As shown in FIG. 16(*h*), the eighth plate 76 of the lowermost layer has 10 elliptical holes 178*a* that correspond to the 10 elliptical holes 177*a* formed in the seventh plate 177, and a through hole 178*b* that corresponds to the main passage 176*b* of the sixth plate 176. The lower surface of the eighth plate 178 is formed by half-etching or the like so that only the peripheral portions of the elliptical holes 178*a* project downward (the portion surrounded by the dotted line in the figure), only the projecting portions thereof are fixed to the upper surface of the passage unit 4, and the portions thereof other than the projecting portions are separated from the passage unit 4 (see FIG. 2).

The seven plates 171, 173-178, and the one damper sheet 172, are aligned together and stacked as shown in FIG. 15, and are fixed to each other. In addition, as shown in FIG. 16(*a*)-(*h*), four rectangular cut-outs 53*g*-53*m* are formed in a staggered pattern along the lengthwise direction on both ends (two on each end) in the Y direction of each plate 171, 173-178. By vertically aligning the plates 171, 173-178, and the damper sheet 172 together, recesses 53 that pass through the reservoir unit 170 in the vertical direction are formed by means of the cut-outs 53*g*-53*m*. The width of the reservoir unit 170 is substantially the same as the width of the passage unit 4, excluding the recesses 53.

As shown in FIG. 15, a supply joint 91 is fixed to the upper surface of the first plate 171 that corresponds to the round hole 171*a*. A discharge joint 92 is fixed to the upper surface of the first plate 171 that corresponds to the round hole 171*b*. The joints 91, 92 are tubular members having base ends 91*b*, 92*b* that are slightly larger than the outer diameter, and are provided so that the opening of the tubular space 91*a* in the lower surface of the base end 91*b* matches the round hole 171*a* of the first plate 171, and the opening of the tubular space 92*a* in the lower surface of the base end 92*b* matches the round hole 171*b* of the first plate 171.

Next, the ink flow within the reservoir unit 170 when ink is supplied thereto will be described. First, the flow of the ink from the supply joint 91 into the reservoir unit 170 (shown with the solid black arrows in FIG. 15) will be described.

As shown with the solid black arrows in FIG. 15, ink that has flowed into the round hole 171*a* through the tubular space 91*a* of the supply joint 91, will then flow through the round hole 172*a* and the round hole 173*a* to the upstream ink storage chamber 181*a*. The upstream ink storage chamber 181*a* is formed by the elliptical recess 174*c* formed in the fourth plate 174. The ink that has flowed into the upstream ink storage chamber 181*a* will flow through the filter 73*f*, and into the downstream ink storage chamber 181*b*. The downstream ink storage chamber 181*b* is formed by the elliptical hole 174*e* formed in the fourth plate 174. The ink that has flowed into the downstream ink storage chamber 181*b* will pass through the round hole 175*a* in the fifth plate 175, and into the approximate center of the main passage 176*b* of the sixth plate 176. After that, as shown with the arrows in FIG. 16(*f*), the ink will move from the approximate center of the main passage 176*b* toward both ends in the lengthwise direction thereof, and toward the tips of each branch passage 176*c*. The ink that has reached both ends of the main passage 176*b* in the lengthwise direction, and the tips of each branch passage 176*c*, will flow through the elliptical holes 177*a*, 178*a*, and into the reception ports 5*b* (see FIG. 5) that are open on the upper surface of the passage unit 4.

The ink that has flowed into the upstream ink storage chamber 181*a* will flow through the damper connection port 174*h*, and into the damper chamber 182. The damper chamber 182 is formed by the elliptical hole 173*c* that is formed in the third plate 173, and the elliptical recess 174*f* that is formed in the fourth plate 174. Note that when the ink is first introduced, by discharging the ink that has flowed into the damper chamber 182 from the discharge joint 92 to the exterior, air bubbles in the upstream ink storage chamber 181*a* and the damper chamber 182 can be discharged. In other words, ink can be filled in a state in which there are no air bubbles in the space on the upstream side of the filter 174.

Ink will be temporarily stored in the upstream ink storage chamber 181*a* and the downstream ink storage chamber 181*b*.

Next, the flow of ink that is discharged from the discharge joint 92 during a reverse purge will be described (shown with the hollow white arrows in FIG. 15). During a reverse purge, cleaning ink will flow through the reception ports 5*b* into the reservoir unit 170. The cleaning ink that has flowed into the reservoir unit 170 will pass through the elliptical holes 178*a*, 177*a*, arrive at the downstream ink collection chamber 181*b*, pass through the filter 174*g*, and flow into the upstream ink storage chamber 181*a*. The cleaning ink that has flowed into the upstream ink storage chamber 181*a* will, as shown with the hollow white arrows in the figure, pass through the damper chamber 182 and the round holes 173*b*, 172*b*, 171*b*, and be discharged from the discharge joint 92. At this time, the ink that is in the passage unit 4 and the reservoir unit 170 will be pushed out by the cleaning ink and will be discharged together with the cleaning ink. Foreign matter that has been captured by the filter 174*g* will also be discharged, and thus the cleanliness of the passages and the filter capabilities will be restored.

Here, the wall that defines the damper chamber 182 is formed by the damper sheet 172. In addition, the elliptical recess 171*c* faces the area that faces the elliptical hole 173*c*, and the damper sheet 172 is interposed therebetween. The space that is defined by the damper sheet 172 and the recess 171*c* is connected to the atmosphere by means of the round hole 171*d*. In other words, the damper sheet 172 is interposed between the ink inside the damper chamber 182 and the atmosphere. The damper sheet 172 is both deformable on the recess 171*c* side, and deformable on the elliptical hole 173*c* side. By deforming the damper sheet 172, the volume of the damper chamber 182 can be changed.

The bottom of the recess 171*c* limits the excessive displacement of the damper sheet 172. In other words, the first plate 171 is a limiting member for limiting the displacement of the damper sheet 172. Note that the limiting member does not only limit the displacement of the damper sheet 172, but will also prevent external forces that lead to damage of the damper sheet 172 from being directly applied to the damper sheet 172. In this way, the handling of the ink jet head 1 will be easy, and will contribute to a longer lifespan.

As described above, according to the inkjet head of the present embodiment, the damper sheet 172 will deform in response to pressure inside the ink jet head 1, and thus like with the first embodiment described above, pressure fluctuations that are produced in the ink jet head 1 will be controlled or suppressed. Because the pressure applied to the ink is stable, a stable quantity of ink can be jetted.

When the air chamber 60*y* is provided on the discharge valve 60, it will function as a second volume adjustor. Because the oscillation energy of the pressure will be absorbed by the air maintained in the air chamber 60*y*, the pressure fluctuations produced inside the head 1 can be effectively controlled. In the present embodiment, the main passage 176*b* of the downstream ink storage chamber reservoir 181*b* faces the atmosphere through the seventh plate 177 that is extremely thin compared to other plates. The thin seventh plate 177 functions as a third volume adjustor. A damper effect will be achieved that reduces the pressure fluctuations that occur in the ink inside the downstream ink storage chamber 181*b*. The damper sheet 172 of the damper chamber 182, the air chamber 60*y* of the discharge valve 60, and the flexible seventh plate 177 are constructed to control or suppress the pressure fluctuations that occur in the ink within the passage unit 4. In this way, the transport of the pressure fluctuations to the passage unit 4 can be reliably controlled or suppressed to the point that they have no impact on the discharge characteristics of the ink. Note that the constituent elements that control these pressure fluctuations are not all necessarily needed, and any one or combination of these may be used.

The damper sheet 172 may be stacked, and thus installing the damper sheet 172 is easy. Because the first plate 171 limits excessive deformation of the damper sheet 172, damage to the damper sheet 172 will be avoided. Because the damper sheet 172 is provided inside the reservoir unit 170, a compact ink jet head 1 can be achieved. In addition, because the damper chamber is provided near the ink supply passages, pressure fluctuations that occur inside the ink jet head 1 can be effectively controlled. In addition, because the ink supply port 171*a* and the damper connection port 174*h* are connected to the upstream ink storage chamber 181*a*, when ink is supplied from the ink supply port 171*a* to the upstream ink storage chamber 181*a*, ink can also flow from the damper connection port 174*h* to the ink discharge passage. In this way, foreign matter in the ink storage chamber 181*a* upstream of the filter 174 can be discharged, and a reduction in the filter's effects can be prevented. In addition, even if ink that contains foreign matter flows back from the ink discharge passage side to the upstream ink storage chamber 181*a*, the foreign matter will not penetrate into the downstream ink storage chamber 181*b* because of the existence of the filter 174*g*.

Although a preferred embodiment of the present invention was described above, the present invention is not limited to the embodiments described above, and various design modifications are possible within the scope of the claims.

In the aforementioned embodiment, the passage unit 4 and the reservoir units 70, 170 are manufactured separately and later assembled together, however the present invention is not limited to that. It is also possible to use a body in which the passage unit 4 and the reservoir unit 70, 170 are made unitary with each other.

In the present invention, the fifth plate 75 and the seventh plate 177 are extremely thin, form walls that define the downstream storage units 74*a*, 181*b*, and are deformable in response to pressure inside the head 1. However, these thin sheets need not form a portion of the walls that define an ink storage chamber.

In addition, the filters 73*f*, 174*g* that divide the ink reservoir into an upstream area and a downstream area need not be provided.

The air chamber 60*y* inside the discharge valve 60 may be a variety of structures, so long as they can capture air. In addition, if a component that can hold air is provided in a portion of the discharge passage (the round hole 73*c*, the long narrow hole 72*c*, the round hole 71*b*, the discharge joint 92, and the tube 111 in the aforementioned embodiment), the air chamber 60*y* may be omitted. The discharge valve 60 is not limited to a structure having the ball valve 64 and the spring 63 as described above, and may be a variety of structures.

In the first embodiment, an air chamber was provided along the discharge passage, but a passage that connects an ink storage space with the air chamber may be provided separately from the discharge passage.

In the damper passage pipe 160 of the second embodiment, the damper sheet 162 is fixed to the inner surface of the peripheral wall 161*b*. However, the damper sheet 162 may be fixed to the outer surface thereof. In addition, a hole may be formed in a portion of the damper passage, e.g., the tube 111, and the damper sheet 162 may be installed in a position that caps the opening of the hole. Furthermore, a plurality of holes 161*z* may be formed in the peripheral wall 161*b* of the damper passage 160 of the second embodiment, from the perspective of protecting the damper sheet 162 and increasing the damper effect. In general, the damper effect can be increased by increasing the size of the damper sheet 162. However, when there is only one hole 161*z*, the desired increase in the damper effect cannot be expected when the hole 161*z* is capped. In addition, when the size of the opening of the hole 161*z* is increased and the size of the damper sheet 162 is increased, a damper sheet 162 composed of a thin material will be easily damaged. Accordingly, in order avoid these problems, it is desirable to form a plurality of holes 161*z* in the peripheral wall 161*b*, as described above. This is also ideal from the perspective of preventing a reduction in the structural strength of the damper passage pipe 160.

In the third embodiment, the first plate 171 is a limiting member that limits the deformation of the damper sheet 172. However, the first plate 171 may be a structure that does not limit deformation of the damper sheet 172. Even in this situation, it is ideal to construct the limiting member so as to prevent the direct application of external forces that lead to damage of the damper sheet 172, or perform steps so that the damper sheet 172 is isolated from the external forces. The upper cover 51 and the lower cover 52 that are mounted on the upper surface of the reservoir unit 170 prevent the application of external forces on the damper sheet 172.

In addition, in the third embodiment, the damper sheet 172 is installed on the outer surface of the damper chamber 182, but the damper sheet may be installed on the inner surface of the damper chamber 182. Furthermore, the step that is provided for the filter 174*g* in the third embodiment may be formed at a depth from the bottom of the elliptical hole 174*d* that corresponds to the thickness of the filter 174*g*. In this way, foreign material and remaining air bubbles will be quickly discharged because ink will no longer accumulate on the filter 174*g*. In addition, little ink will be discharged to the exterior at this time. Furthermore, the through hole 76*b* (the sixth plate 76) and the through hole 178*b* (the eighth plate 178) of the aforementioned embodiments need not be formed so as to pass through each plate 76, 178. In other words, they may be each formed as a recess having a bottom portion. In this way, the fifth plate 75 and the seventh plate 177 that are extremely thin compared to other plates will be isolated from the outside air. Even if the fifth plate 75 and the seventh plate 177 that are extremely thin are damaged by some chance, the ink can be prevented from leaking from the body.

The ink jet head according to the present invention can also be applied to line type and serial type ink jet printers. Application of the present invention is not limited to printers, and can also be applied to ink jet type facsimile devices and copy machines.

The ink jet printer in which the present embodiment is applied can also be defined as follows:

an ink jet printer, comprising:

a pump for sending ink;

an ink storage space for temporarily storing ink sent by the pump;

an ink passage for introducing ink stored in the ink storage space to a nozzle via a pressure chamber; and an adjustor for increasing volume of the ink storage space, when the pressure within the ink storage space is increased, and decreasing the volume of the ink storage space, when the pressure within the ink storage space is decreased.

The technology applied in the present embodiment can also be applied to something other than an ink jet head. This technology can be widely applied to devices that jet droplets such as ink droplets. Thus, the technology that is applied in the present embodiment can also be defined as follows:

An apparatus for jetting droplets, comprising:

a pump for sending liquid;

a storage space for temporarily storing liquid sent by the pump;

a passage for introducing liquid stored in the storage space to a nozzle via a pressure chamber; and an adjustor for increasing volume of the storage space when a pressure within the storage space is increased and decreasing volume of the storage space when the pressure within the storage space is decreased.

For example, the liquid storage space is formed by the upstream ink storage chamber 72*b*, the downstream ink storage chamber 74*a*, the manifold passages 5, or the sub-manifold passages 5*a*. The passage for introducing the liquid stored in the liquid storage space to the nozzles via the pressure chambers can be constructed by the individual ink passages 32 and the like. The air chamber 60*y*, the flexible sheet 162, and the flexible sheet 172 correspond to examples of an adjustor, which increase the volume of the liquid storage space when the pressure of the liquid stored in the liquid storage space rises, and lowers the volume of the liquid storage space when the pressure of the liquid stored in the liquid storage space decreases.

What is claimed is:

1. An ink jet head comprising:

a body;

a common ink storage chamber formed within the body;

a common ink passage formed within the body configured to introduce ink supplied from an exterior of the body to the common ink storage chamber;

an ink discharge passage configured to discharge ink within the common ink storage chamber to an exterior of the body;

a common ink storage space including the common ink storage chamber, the common ink passage and the ink discharge passage, the common ink storage space being filled with ink;

a valve configured to selectively open and close the ink discharge passage;

a plurality of nozzles distributed on a first face of the body;

a plurality of pressure chambers formed within the body, the number of the pressure chambers being equal to the number of the nozzles;

a plurality of individual ink passages formed within the body, each individual ink passage extending from the common ink storage chamber to one of the nozzles through one of the pressure chambers; and an adjuster configured to allow volume change of the common ink storage space, wherein the adjuster includes a through-hole formed on a wall defining the ink discharge passage and a flexible sheet closing the through-hole and separating the ink discharge passage from atmosphere and the ink discharge passage is configured to discharge ink to an exterior of the body at a location separate from the nozzles.

2. An ink jet head as defined in claim 1, wherein a hole is formed at a wall defining the ink discharge passage, the flexible sheet is provided within the ink discharge passage, and a periphery of the flexible sheet is adhered to the wall surrounding the hole.

3. An ink jet head as defined in claim 1, wherein a hole is formed at a wall defining the ink discharge passage, the flexible sheet is provided outside of the ink discharge passage, and a periphery of the flexible sheet is adhered to the wall surrounding the hole.

4. An ink jet head as defined in claim 1 wherein a wall defining the ink discharge passage is formed of a flexible material.

5. An ink jet head as defined in claim 1, further comprising:

an additional flexible sheet located within the body.

6. An ink jet head as defined in claim 5, wherein the body includes a plurality of stacked thin plates, and one of the stacked thin plate is the flexible sheet.

7. An ink jet head as defined in claim 1, further comprising:

a limiter configured to limit maximum deformation of the flexible sheet.

8. An inkjet head as defined in claim 1, further comprising:

a filter configured to divide the common ink storage space into a upper region and a lower region, wherein the adjustor is connected to the upper region.

9. An inkjet head as defined in claim 1, wherein the body includes a first body and a second body fixed to the first body, wherein the first body includes the common ink passage, and a first part of the common ink storage chamber, and wherein the second body includes a second part of the common ink storage chamber, the plurality of individual ink passages, the plurality of pressure chambers, and the plurality of nozzles.

10. An ink jet head as defined in claim 9, further comprising:

a plurality of actuators, each actuator facing one of the pressure chambers and changing pressure of the corresponding pressure chamber, wherein the plurality of pressure chambers is distributed on a second face of the body, and the plurality of actuators is formed within an sheet like actuator unit overlapping the second face.

11. An ink jet head comprising:

a body;

a common ink storage chamber formed within the body;

a common ink passage formed within the body;

an ink discharge passage configured to discharge ink within the common ink storage chamber to an exterior of the body;

a common ink storage space including the common ink storage chamber, the common ink passage and the ink discharge passage;

a valve configured to selectively open and close the ink discharge passage;

a plurality of nozzles distributed on a first face of the body;

a plurality of pressure chambers formed within the body;

a plurality of individual ink passages formed within the body, each individual ink passage extending from the common ink storage chamber to one of the nozzles through one of the pressure chambers; and an adjuster configured to allow volume change of the common ink storage space;

wherein the adjuster includes a through-hole formed on a wall defining the ink discharge passage and a flexible sheet closing the through-hole and separating the common ink storage space from atmosphere and the ink discharge passage is configured to discharge ink to an exterior of the body at a location separate from the nozzles.

* * * * *